US012709823B2

(12) United States Patent
Dyckmans et al.

(10) Patent No.: US 12,709,823 B2
(45) Date of Patent: Aug. 18, 2026

(54) MULTI-THREAD AUTOMATED WINDING FOR ARTICLES OF APPAREL

(71) Applicant: adidas AG, Herzogenaurach (DE)

(72) Inventors: Clemens Paul Dyckmans, Nuremberg (DE); Thomas Feix, Herzogenaurach (DE); Simon Stegmueller, Thu Duc City (VN); Fionn Corcoran-Tadd, Portland, OR (US)

(73) Assignee: adidas AG, Herzogenaurach (DE)

( * ) Notice: Subject to any disclaimer, the term of this patent is extended or adjusted under 35 U.S.C. 154(b) by 134 days.

(21) Appl. No.: 18/400,656

(22) Filed: Dec. 29, 2023

(65) Prior Publication Data

US 2025/0215621 A1 Jul. 3, 2025

(51) Int. Cl.
*D03D 23/00* (2006.01)

(52) U.S. Cl.
CPC ..... *D03D 23/00* (2013.01); *D10B 2501/00* (2013.01)

(58) Field of Classification Search
CPC .... D04H 3/045; B65H 57/02; B65H 54/2836; B29C 70/384
See application file for complete search history.

(56) References Cited

U.S. PATENT DOCUMENTS 2,386,269 A 10/1945 Ryan
2,430,497 A 11/1947 Enright
3,296,490 A 1/1967 Price
4,287,808 A * 9/1981 Leonard ..... D04C 3/42 310/13
4,311,080 A * 1/1982 Leonard ..... H02K 41/025 87/29
4,693,429 A * 9/1987 Billard ..... B65H 57/16 242/157 R
4,724,612 A 2/1988 Pearson
5,706,590 A 1/1998 Candela et al.
6,843,280 B2 1/2005 Cahuzac et al.
7,540,097 B2 6/2009 Greene et al.
7,703,220 B2 4/2010 Aveni
7,774,884 B2 8/2010 Greene et al.
8,056,173 B2 11/2011 Rongbo
(Continued)

FOREIGN PATENT DOCUMENTS

CN 102232671 A 11/2011
CN 102497792 A 6/2012
(Continued)

OTHER PUBLICATIONS

MAWS one—Martin Sallieres, Martzer, Jul. 12, 2017, https://vimeo.com/225224055.
(Continued)

*Primary Examiner* — Jillian K Pierorazio
(74) *Attorney, Agent, or Firm* — Sterne, Kessler, Goldstein & Fox P.L.L.C.

(57) ABSTRACT

A system for manufacturing an article of apparel includes a plate with a plurality of projections. The system also includes a winding head with a plurality of adjacent thread guides. The thread guides among the plurality of thread guides are configured to simultaneously dispense respective continuous threads. The system also includes an actuator configured to move the winding head over the plate to wind the continuous threads around the plurality of projections on the plate.

19 Claims, 16 Drawing Sheets

(56) References Cited

U.S. PATENT DOCUMENTS

| | | | | |
|---|---|---|---|---|
| 8,065,818 | B2 | 11/2011 | Greene et al. | |
| 8,850,723 | B2 | 10/2014 | Greene et al. | |
| 8,906,275 | B2 | 12/2014 | Davis et al. | |
| 8,925,195 | B2 | 1/2015 | Schmidt et al. | |
| 9,227,363 | B2 | 1/2016 | Dua et al. | |
| 9,402,444 | B2 | 8/2016 | Dojan et al. | |
| 9,427,047 | B2 | 8/2016 | Dojan et al. | |
| 9,462,851 | B2 | 10/2016 | Baker et al. | |
| 9,675,134 | B2 | 6/2017 | Kosui et al. | |
| 9,681,708 | B2 | 6/2017 | Greene et al. | |
| 9,732,454 | B2 | 8/2017 | Davis et al. | |
| 10,194,714 | B2 | 2/2019 | Mcginnity et al. | |
| 10,619,280 | B2 | 4/2020 | Luedecke et al. | |
| 10,874,172 | B2 | 12/2020 | Corcoran-Tadd et al. | |
| 10,993,497 | B2 | 5/2021 | Gaba | |
| 12,161,191 | B2 | 12/2024 | Corcoran-Tadd et al. | |
| 2004/0118018 | A1 | 6/2004 | Dua | |
| 2006/0090314 | A1* | 5/2006 | Delecroix | F16D 69/023 28/100 |
| 2007/0271822 | A1 | 11/2007 | Meschter | |
| 2010/0018075 | A1 | 1/2010 | Meschter et al. | |
| 2010/0071177 | A1* | 3/2010 | Yoshikawa | D04H 3/04 28/217 |
| 2010/0218902 | A1* | 9/2010 | Yoshikawa | D04H 3/04 156/441 |
| 2010/0251491 | A1 | 10/2010 | Dojan et al. | |
| 2010/0251564 | A1 | 10/2010 | Meschter | |
| 2012/0023786 | A1 | 2/2012 | Dojan | |
| 2012/0055044 | A1 | 3/2012 | Dojan et al. | |
| 2012/0233882 | A1 | 9/2012 | Huffa et al. | |
| 2013/0019500 | A1 | 1/2013 | Greene | |
| 2013/0025159 | A1 | 1/2013 | Dojan et al. | |
| 2013/0219636 | A1 | 8/2013 | Dojan et al. | |
| 2013/0219750 | A1 | 8/2013 | Dojan et al. | |
| 2013/0248639 | A1* | 9/2013 | Matthies | B65H 54/2839 242/472.6 |
| 2013/0340283 | A1 | 12/2013 | Bell et al. | |
| 2014/0068968 | A1 | 3/2014 | Podhajny et al. | |
| 2014/0130372 | A1 | 5/2014 | Aveni et al. | |
| 2014/0173938 | A1 | 6/2014 | Beye et al. | |
| 2014/0237861 | A1 | 8/2014 | Podhajny | |
| 2014/0373389 | A1 | 12/2014 | Bruce | |
| 2015/0040428 | A1 | 2/2015 | Davis et al. | |
| 2015/0047225 | A1 | 2/2015 | Zavala et al. | |
| 2015/0059209 | A1 | 3/2015 | Dekovic et al. | |
| 2015/0164175 | A1 | 6/2015 | Katsuya | |
| 2015/0250256 | A1 | 9/2015 | Podhajny | |
| 2015/0272274 | A1 | 10/2015 | Berns et al. | |
| 2015/0359290 | A1 | 12/2015 | Podhajny et al. | |
| 2016/0058100 | A1 | 3/2016 | Dealey et al. | |
| 2016/0058121 | A1 | 3/2016 | Langvin et al. | |
| 2016/0088893 | A1 | 3/2016 | Meir | |
| 2016/0135543 | A1 | 5/2016 | Anceresi et al. | |
| 2016/0168774 | A1 | 6/2016 | Breithaupt et al. | |
| 2016/0192741 | A1 | 7/2016 | Mark | |
| 2016/0206044 | A1* | 7/2016 | Dimoff | A43C 1/04 |
| 2017/0035149 | A1* | 2/2017 | Bruce | D04C 3/08 |
| 2017/0202296 | A1 | 7/2017 | Fuerst, Jr. et al. | |
| 2017/0202309 | A1 | 7/2017 | Sterman et al. | |
| 2017/0245582 | A1 | 8/2017 | Green et al. | |
| 2017/0347754 | A1 | 12/2017 | Fuerst, Jr. et al. | |
| 2018/0110298 | A1 | 4/2018 | Schneider et al. | |
| 2018/0148861 | A1 | 5/2018 | Tarrier et al. | |
| 2018/0271216 | A1* | 9/2018 | La O' | B32B 5/02 |
| 2019/0274392 | A1 | 9/2019 | Amis et al. | |
| 2019/0307208 | A1* | 10/2019 | Corcoran-Tadd | A43B 23/04 |
| 2019/0380425 | A1 | 12/2019 | Wood et al. | |
| 2020/0154816 | A1* | 5/2020 | Gaba | A43C 1/04 |
| 2020/0397090 | A1 | 12/2020 | Meir et al. | |
| 2021/0100316 | A1 | 4/2021 | Corcoran-Tadd et al. | |
| 2021/0235807 | A1 | 8/2021 | Casillas et al. | |
| 2022/0007789 | A1 | 1/2022 | Corcoran-Tadd et al. | |
| 2022/0104588 | A1 | 4/2022 | Zinner et al. | |
| 2023/0081164 | A1 | 3/2023 | Byun et al. | |
| 2024/0164483 | A1 | 5/2024 | Corcoran-Tadd et al. | |
| 2024/0324699 | A1 | 10/2024 | Hirst et al. | |
| 2025/0098817 | A1 | 3/2025 | Corcoran-Tadd et al. | |
| 2025/0107583 | A1 | 4/2025 | Corcoran-Tadd et al. | |
| 2025/0213003 | A1 | 7/2025 | Dyckmans et al. | |
| 2025/0215622 | A1 | 7/2025 | Dyckmans et al. | |
| 2025/0215626 | A1 | 7/2025 | Dietrich et al. | |
| 2025/0215627 | A1 | 7/2025 | Feix et al. | |
| 2025/0327226 | A1 | 10/2025 | Conklin et al. | |

FOREIGN PATENT DOCUMENTS

| | | | |
|---|---|---|---|
| CN | 204207163 | U | 3/2015 |
| CN | 105263351 | A | 1/2016 |
| CN | 107072353 | A | 8/2017 |
| EP | 3549470 | A1 | 10/2019 |
| EP | 3780985 | B1 | 9/2021 |
| JP | 11006005 | Y | 12/1936 |
| JP | S4939620 | B1 | 10/1974 |
| JP | 2015014058 | A | 1/2015 |
| JP | 2016524941 | A | 8/2016 |
| JP | 2017148422 | A | 8/2017 |
| TW | M645298 | U | 8/2023 |
| WO | WO-9843506 | A1 | 10/1998 |
| WO | WO-2014074928 | A1 | 5/2014 |
| WO | WO-2017115806 | A1 | 7/2017 |
| WO | WO-2017214199 | A1 | 12/2017 |

OTHER PUBLICATIONS http://modern-synthesis.com; retrieved Jul. 13, 2020.

Martzer_, "2 hours to go!" Instagram.com, posted Jun. 27, 2017, https://www.instagram.com/p/BV1vc2KFXHq/.

Martzer_, "3d woven shoe" Instagram.com, posted Feb. 27, 2018, https://www.instagram.com/p/BftFi9siS4xl.

Martzer_, "Always experimenting! I wove some cotton thread on the last and stiffened it with latex. The outcome is interesting and promising for the future of my research. I shape the sole in hard foam!" Instagram.com, posted May 29, 2017, https://www.instagram.com/p/BUrTEigFmeX/.

Martzer_, "Experimenting with new material, and shapes! I am taking the opportunity here to thank you all for the upport and the likes!" Instagram.com, posted Sep. 25, 2017, https://www.instagram.com/p/BZd_qiSICKu/.

Martzer_, "I am back at it! This time it's to hopefully graduate from @design_academy_eindhoven I am continuing my dweaving and printing experiments from last semester and this is the first model! Stay posted if you want to follow the est of the process!" Instagram.com, posted Sep. 16, 2017, https://www.instagram.com/p/BZG217t1Rfu/.

Martzer_, "Small update on my research, this model is from two weeks ago. I'll be showing my final model on Tuesday or my last endterms before graduation! Stay posted . . . " Instagram.com, posted Jun. 22, 2017, https://www.instagram.com/p/BVpfr5pFVEf/.

Martzer_, "My outcome of the past two months! End terms are tomorrow, wish me luck! More photos of the project will come after tomorrow!" instagram.com, posted Jun. 26, 2017, https://www.instagram.com/p/BVzVqEiFw-a/.

Martzer_, "Off to graduation now! . . . " Instagram.com, posted Jun. 29, 2017, https://www.instagram.com/p/ BV7t3eSFolc/.

Martzer_, "Some close up shots of my graduation project "Shoelab" which you witnessed the process on my instram account throughout the past few month! Thank you all for the constant feedback and support! I hope you liked it!" instagram.com, posted Jan. 26, 2018, https://www.instagram.com/p/BeaOE5QIDIX/.

Martzer_, "The graduation period is coming to an end, one month left! Here is one of my latest experiments that I did a few weeks back! Also, any idea how to name this project? I'm struggling a bit haha" Instagram.com, posted Dec. 9, 2017, https:/lwww.instagram.com/p/Bc43txTFS36.

Martzer_, "Two weeks before green light good to have a small overview of my progress so far" Instagram.com, posted Nov. 6, 2017, https://www.instagrams.com/p/BbJ1dpqleah/.

Martzer_, "Yesterday I graduated Cum Laude from @design_academy_eindhoven! One of my project being this 3D Woven shoe!

(56) References Cited

OTHER PUBLICATIONS

More pictures to come!" Instagram.com, posted Jan. 24, 2018, https://www.instagram.com/p/ BeVw-21F26T/.

* cited by examiner

MULTI-THREAD AUTOMATED WINDING FOR ARTICLES OF APPAREL

FIELD

The described embodiments generally relate to apparel and methods of making apparel. In particular, described embodiments relate to apparel comprising a layer made by winding one or more continuous threads around anchor points.

BACKGROUND

Apparel can be manufactured from various materials using a wide range of techniques, including weaving and knitting. Individuals are often concerned with the durability, comfort, and/or performance characteristics for an article of apparel. This is true for apparel worn for athletic and non-athletic activities. Proper apparel should be durable, comfortable, and provide other beneficial characteristics for an individual. Therefore, a continuing need exists for innovations in apparel and methods of making apparel to suit individuals across a range of use cases. Particularly, there is a need for methods of making materials for apparel that have customizable characteristics yet can be efficiently manufactured in large quantities and/or sizes.

BRIEF SUMMARY

A first embodiment (1) of the present disclosure is directed to a system for manufacturing an article of apparel. The system can comprise a plate comprising a plurality of projections. The system can comprise a winding head comprising a plurality of adjacent thread guides, wherein the thread guides among the plurality of thread guides are configured to simultaneously dispense respective continuous threads. The system can comprise an actuator configured to move the winding head over the plate to wind the continuous threads around the plurality of projections on the plate.

In a second embodiment (2) further to the first embodiment (1), the plurality of adjacent thread guides can be arranged linearly on the winding head.

In a third embodiment (3) further to the first embodiment (1) or the second embodiment (2), center points of the thread guides among the plurality of thread guides can be spaced apart from each other on the winding head in a first direction by a first distance. And the center points of the projections among the plurality of projections can be spaced apart from each other on the plate by the first distance.

In a fourth (4) embodiment further to the third embodiment (3), the plurality of thread guides can be coupled to a bottom surface of the winding head within an area that spans a second distance in a second direction that is less than the first distance such that the plurality of thread guides can pass between two adjacent projections of the plurality projections sequentially as the winding head moves in a straight line.

In a fifth embodiment (5) further to any one of embodiments (1)-(4), the actuator can be configured to cause the winding head to translate relative to a lateral plane.

In a sixth embodiment (6) further to any one of embodiments (1)-(5), the system comprises a second actuator configured to rotate the winding head on a rotation axis.

In a seventh embodiment (7) further to the sixth embodiment (6), the rotation axis can be perpendicular to the lateral plane.

In an eighth embodiment (8) further to any one of embodiments (1)-(7), the system can comprise a plurality of spools. And each of the respective continuous threads extends from a respective spool among the plurality of spools such that dispensing the respective continuous threads unwinds the plurality of spools.

In a ninth embodiment (9) further to the eighth embodiment (8), each spool among the plurality of spools can be biased toward winding a corresponding one of the respective threads about the spool.

In a tenth embodiment (10) further to the eighth embodiment (8) or the ninth embodiment (9), a first one of the plurality of spools can comprise a first thread type and a second one of the plurality of spools comprises a second thread type different from the first thread type.

In an eleventh embodiment (11) further to any of embodiments (1)-(10), the winding head can comprise at least four thread guides.

A twelfth embodiment (12) of the present disclosure is directed to a method of manufacturing an article of apparel. The method can comprise threading a plurality of continuous threads onto a plurality of projections in a projection set disposed around a winding field by passing a plurality of thread guides on a winding head between the plurality of projections. The thread guides can simultaneously dispense respective continuous threads such that continuous threads are wound around the plurality of projections to form a thread layer comprising a plurality of thread lines, with each thread line extending between two respective projections of the plurality of projections and across the winding field.

In a thirteenth embodiment (13) further to the twelfth embodiment (12), winding the continuous threads can comprise moving the winding head relative to the projection set and across the winding field.

In a fourteenth embodiment (14) further to the thirteenth embodiment (13), the plurality of projections can extend from a support plate.

In a fifteenth embodiment (15) further to any one of embodiments (12)-(15), threading the plurality of continuous threads can comprise a first passing step wherein respective continuous threads are each passed through a respective gap defined between a respective pair of adjacent projections among the projection set.

In a sixteenth embodiment (16) further to the fifteenth embodiment (15), the respective continuous threads can each be passed through the respective gap simultaneously.

In a seventeenth embodiment (17) further to the fifteenth embodiment (15) or the sixteenth embodiment (16), the first passing step can comprise passing each thread guide among the plurality of thread guides through a respective one of the respective gaps.

In an eighteenth embodiment (18) further to any one of embodiments (15)-(17), the method can comprise a second passing step wherein every continuous thread among the plurality of continuous threads is passed through a single gap defined between a single pair of adjacent projections among the projection set, and the second passing step either follows or precedes the first passing step.

In a nineteenth embodiment (19) further to the eighteenth embodiment (18), the winding head can be rotated between the first passing step and the second passing step.

In a twentieth embodiment (20) further to the eighteenth embodiment (18) or the nineteenth embodiment (19), the second passing step can comprise passing every thread through the single gap sequentially.

In a twenty-first embodiment (21) further to any one of embodiments (12)-(20), the method can further comprise bonding the plurality of threads within the thread layer. And the method can further comprise cutting at least a portion of the thread layer from the plurality of projections.

In a twenty-second embodiment (22) further to the twenty-first embodiment (21), cutting the at least a portion of the thread layer can comprise cutting two separate portions from the thread layer, and each portion can define at least a portion of an upper for an article of footwear.

In a twenty-third embodiment (23) further to any one of embodiments (12)-(22), the plurality of continuous threads can be a first set of continuous threads. The method can further comprise threading a second set of continuous threads onto the plurality of projections over the first set of continuous threads by passing the plurality of thread guides on the winding head between the plurality of projections. The thread guides can simultaneously dispense the respective second continuous threads such that the second continuous threads are wound around the plurality of projections to form a second thread layer over the first thread layer. And the second thread layer can comprise a plurality of second thread lines, with each second thread line extending between two respective projections of the plurality of projections and across the winding field.

BRIEF DESCRIPTION OF THE DRAWINGS/FIGURES

FIG. 1A shows a winding system according to some embodiments.

FIG. 1B schematically represents a portion of the winding system according to some embodiments.

DETAILED DESCRIPTION

Figure 1A:
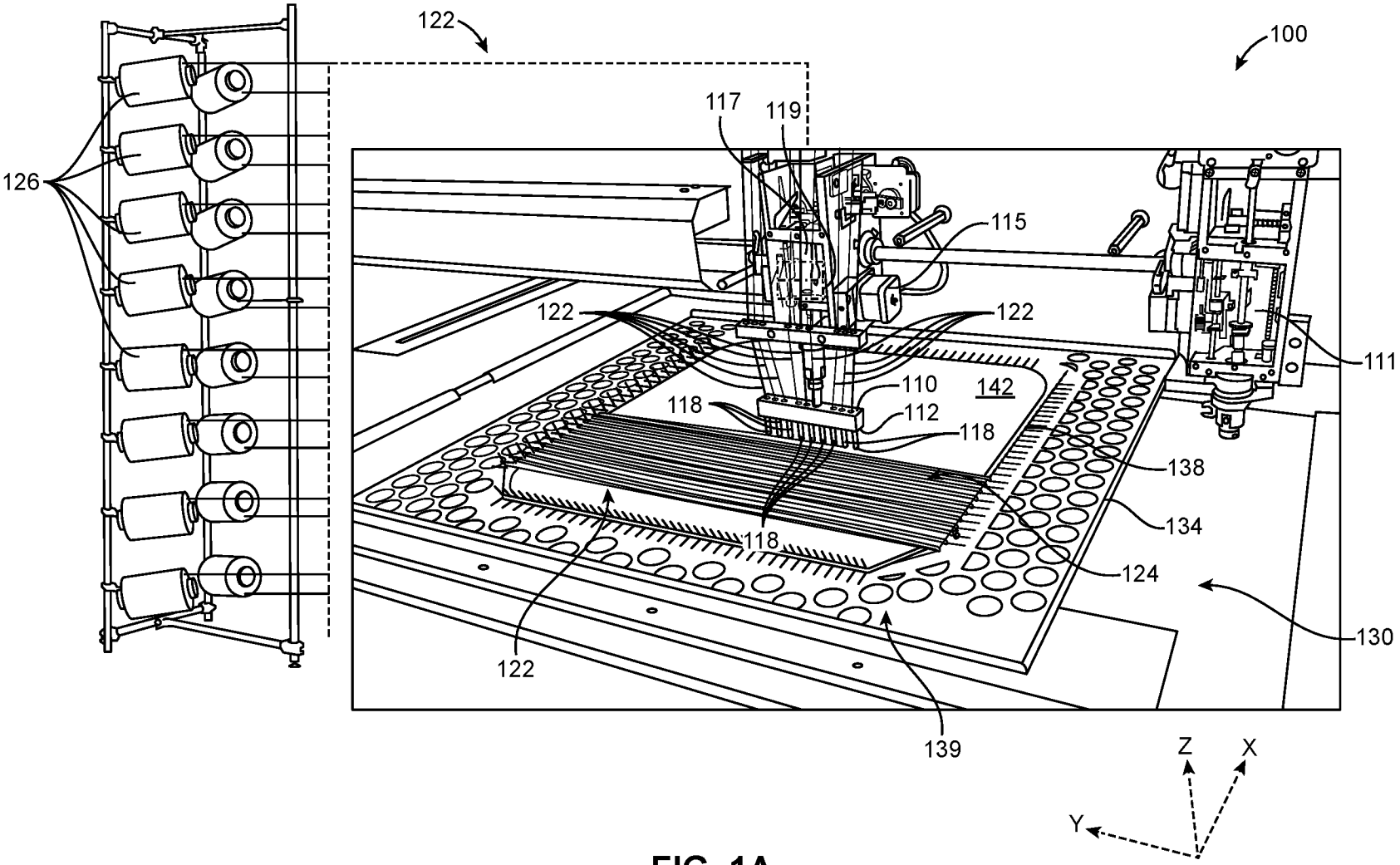

The present invention(s) will now be described in detail with reference to embodiments thereof as illustrated in the accompanying drawings. References to "some embodiments", "one embodiment", "an embodiment", "an exemplary embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The indefinite articles "a," "an," and "the" include plural referents unless clearly contradicted or the context clearly dictates otherwise.

The term "comprising" is an open-ended transitional phrase. A list of elements following the transitional phrase "comprising" is a non-exclusive list, such that elements in addition to those specifically recited in the list can also be present.

As used herein, unless specified otherwise, references to "first," "second," "third," "fourth," etc. are not intended to denote order, or that an earlier-numbered feature is required for a later-numbered feature. Also, unless specified otherwise, the use of "first," "second," "third," "fourth," etc. does not necessarily mean that the "first," "second," "third," "fourth," etc. features have different properties or values.

As used herein, "thread" means a material having a length that is substantially larger than its width. A "thread" can be a filament, a fiber, a yarn, a cable, a cord, a fiber tow, a tape, a ribbon, a monofilament, a braid, a string, a plied thread, and other forms of materials which can be spooled and laid down in a thread pattern as described herein.

As used herein, "apparel" can be any item that is worn or adorns an individual, including both clothing and accessories. Clothing can comprise, but is not limited to pants, shorts, leggings, socks, a shoe, a shoe upper, a jacket, a coat, a hat, a sleeve, a sweater, a shirt, a bra, a jersey, a bootie, a glove, an arm sleeve, a knee sleeve, an elbow sleeve, a wrist sleeve, an ankle sleeve. Accessories can comprise, but are not limited to a headband, a waistband, a belt, a wristband, a bracelet, a watch band, a shoulder wrap, a tape, a shin guard, a hat, a tie, a scarf, a purse, a handbag, a wallet, a knapsack, or a backpack.

An article of apparel has many purposes. Among other things, apparel can provide a unique aesthetic look, provide warming or cooling characteristics, provide support for portions of an individual's body, and provide other performance characteristics, such as air permeability, moisture wicking properties, compression properties. Each of these purposes, alone or in combination, provides for comfortable apparel suitable for use in a variety of scenarios (for example, exercise and every day activities). The features of an article of apparel (for example, the materials and components used to make apparel, and the way these materials/components are made) can be altered to produce desired characteristics, for example, durability, stiffness, weight, tackiness, texture, haptics, tackiness, and/or air permeability.

An article of apparel, or a portion thereof, can be configured to provide various degrees of durability, support, weight, breathability, etc. But the cost of manufacturing the article of apparel can also be a consideration. Apparel, or a portion thereof, that may be manufactured at a relatively low cost can be desirable for manufacturers and consumers. Apparel that can be manufactured using a relatively small amount of resources (for example, energy and labor), materials, and time reduces manufacturing costs and can also reduce the environmental impact of manufacturing.

Further, manufacturing devices and associated processes that facilitate the manufacture of articles of apparel efficiently can be desirable. Efficient manufacture can be facilitated by devices and processes that enable application of relatively large quantities of material, or multiple portions of material, simultaneously or in quick succession. Thus, in winding processes, for example, winding multiple threads simultaneously or in quick succession can contribute to efficient manufacture. Applying material in large quantities, or in multiple simultaneous or successive portions in one step can reduce a total number of steps and therefore a total time and cost in comparison to methods wherein the same. Efficient manufacture can also be facilitated by devices and process that enable the same operation to be performed on multiple articles simultaneously.

Methods and system according to embodiments described herein comprise a winding head comprising multiple thread guides. The winding head can be operated to move the multiple thread guides between projections simultaneously or in quick succession, thereby applying multiple continuous threads at once. In some embodiments, the continuous thread(s) can be wound around and between anchor points, each anchor point being provided by a projection among a projection set to form a thread pattern. Winding the continuous thread(s) around the anchor points comprises wrapping a continuous thread around a first anchor point, extending that continuous thread to a second anchor point, wrapping that continuous thread around the second anchor point, and so on. The number and position of the anchor points can be utilized to control characteristics of the thread pattern, and therefore the article of apparel. Also, the number of times a continuous thread is wound from anchor point to anchor point can be utilized to control characteristics of the thread pattern, and therefore the article of apparel.

According to embodiments described herein, the multiple continuous threads can be combinations of threads of the same thread type or of various thread types. One winding head can wind all of the multiple continuous threads about one or more projections in a single motion. Thus, the winding head with multiple thread guides can be used to quickly and efficiently build a thread layer.

In some embodiments, continuous thread(s) of a thread layer or thread pattern can be bonded within the thread layer or thread pattern. The bonding of continuous thread(s) can consolidate the thread layer or thread pattern and fix thread lines in a wound pattern. In some embodiments, bonding continuous thread(s) of a thread layer or thread pattern can be utilized to control characteristics of the thread pattern. In some embodiments, a continuous thread can be bonded to itself within a thread layer or thread pattern. In some embodiments, a continuous thread can be bonded to itself at one or more anchor points of a thread layer or thread pattern. In some embodiments, a continuous thread can be bonded to itself at points of overlap between different thread lines of the continuous thread (i.e., at thread line intersection points). In some embodiments, different continuous threads of a thread pattern can be bonded together. In some embodiments, different continuous threads can be bonded to each other at one or more anchor points of a thread pattern. In some embodiments, different continuous threads can be bonded to each other at points of overlap between the different continuous threads (i.e., at intersection points between the different continuous threads). The bonding of continuous thread(s) can fix the continuous thread(s) in tension as the thread(s) are wound around anchor points in tension.

In some embodiments, a plurality of different continuous threads can be wound around anchor points to form a thread pattern comprising a plurality of thread layers. In some embodiments, different continuous threads can be wound in the same configuration (i.e., around the same anchor points and along the same paths). In some embodiments, different continuous threads can be wound in different configurations (i.e., around one or more different anchor points and/or along different paths between one or more anchor points). Different continuous threads can define different wound thread layers for an article of apparel. And these different thread layers can provide different characteristics for a thread pattern, and therefore the article of apparel.

FIG. 1A illustrates a system 100 for manufacturing articles of apparel according to some embodiments. System 100 comprises a winding head 110 and a plate 130. Winding head 110 comprises a plurality of adjacent thread guides 118. Thread guides 118 among the plurality of thread guides are configured to simultaneously dispense respective continuous threads 122.

Plate 130 can comprise a base 134 and a plurality of projections 138 extending from base 134. The plurality of projections 138 surround a winding field 142. The plurality of projections 138 comprised by plate 130 collectively forms a projection set 139 on plate 130. During winding, winding head 110 passes across winding field 142 between projections 138. Further during winding, winding field 142 becomes occupied by a thread layer 124, or multiple thread layers 124 forming a thread pattern, as continuous threads 122 are wound on plate 130 to extend between projections 138 on different sides of winding field 142.

Thread guides 118 can each comprise a tube, an eyelet, or other aperture through which one or more continuous threads 122 can pass while being directed by thread guide 118. For example, in some embodiments, a thread guide 118 can comprise one or more tubes or any another structure for passing one or more continuous threads 122 between adjacent projections 138 of projection set 139. A dispensing end of the thread guides 118 can guide continuous threads 122 between adjacent projections 138 of projection set 139 as described herein. In some embodiments, the system 110 can be configured to pass multiple continuous threads 122 simultaneously through one or more of the thread guides 118 in the course of winding continuous threads 122 onto projection set 139.

Figure 1B:
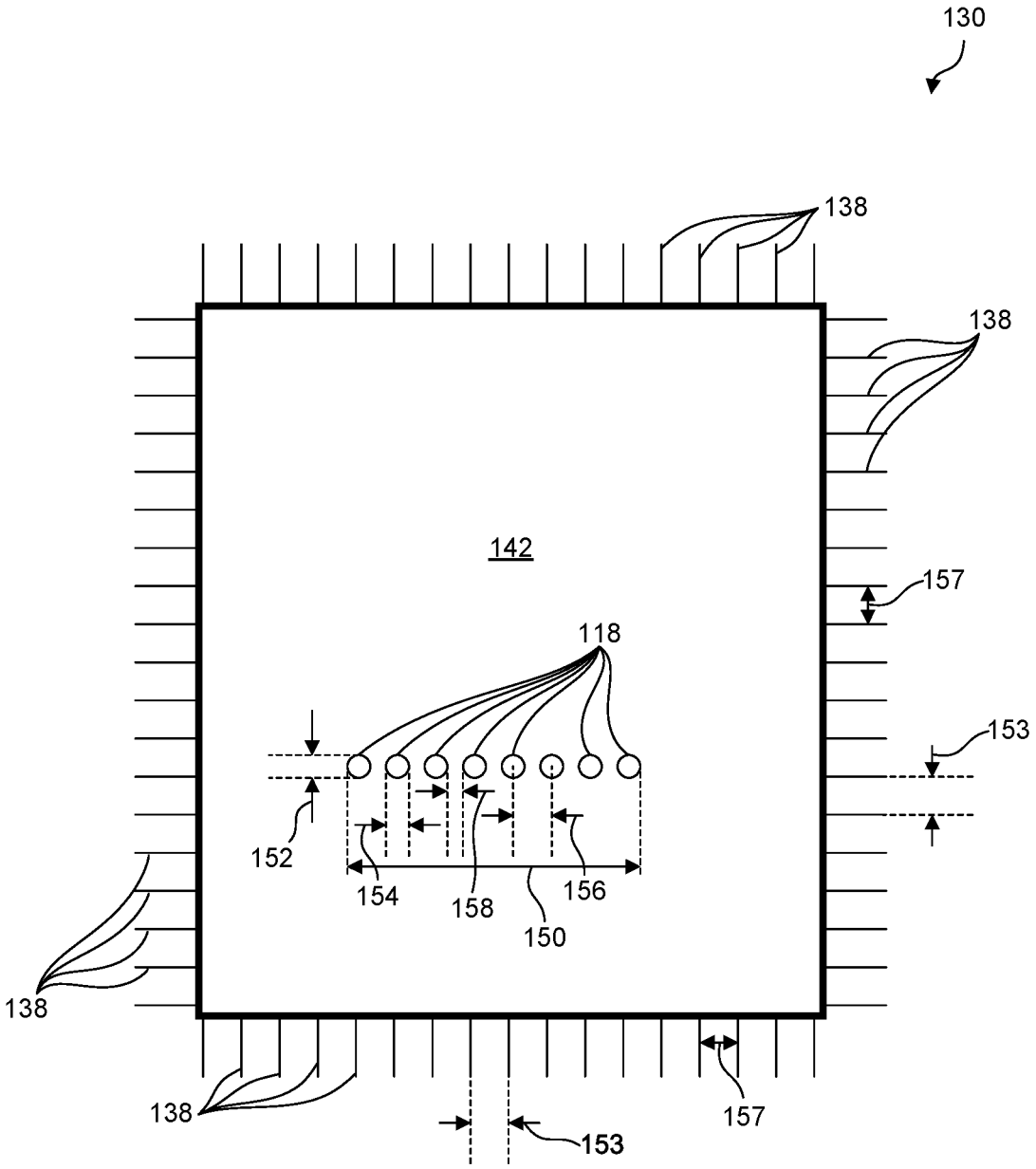

In some embodiments, as illustrated in for example FIGS. 1A and 1B, the plurality of adjacent thread guides 118 can be arranged linearly on winding head 110. In some embodiments, thread guides 118 can be arranged in multiple linear rows on winding head 110. In some embodiments, thread guides 118 can be coupled to a bottom surface 112 of winding head 110.

Winding head 110 of the illustrated embodiment comprises eight thread guides 118. That said, winding head 110 can comprise any number of thread guides 118. Winding head 110 according to some embodiments can comprise at least two thread guides 118. Winding head 110 according to some embodiments can comprise at least four thread guides 118. Winding head 110 according to some embodiments can comprise at least six thread guides 118.

System 100 further comprises one or more actuators, such as actuators 111, 115, 117, and 119, configured to move winding head 110 over plate 130 to wind continuous threads 122 around the plurality of projections 138 on plate 130. The actuator(s) can be configured to cause winding head 110 to translate relative to a lateral plane located above plate 130 and including an X axis and a Y axis perpendicular to the X axis. In some embodiments, system 100 can comprises multiple such actuators. For example, in some embodiments, system 100 can comprise an X-direction actuator 111 and a Y-direction actuator 115. X-direction actuator 111 is configured to move winding head 110 parallel to the X axis. Y-direction actuator 115 is configured to move winding head 110 parallel to the Y axis. Thus, by moving winding head 110 parallel to the X axis and Y axis, X-direction actuator 111 and Y-direction actuator 115 cause winding head 110 to translate relative to the lateral plane. In some embodiments, plate 130 can be arranged to define winding field 142 parallel to the lateral plane. Winding continuous threads 122 around the plurality of projections 138 on plate 130 can be accomplished by translating winding head 110 relative to the lateral plane.

System 100 can enable a method of manufacturing an article of apparel by threading a plurality of continuous threads 122 onto a plurality of projections 138 in the projection set 139 disposed around a winding field 142 by passing a plurality of thread guides 118 on winding head 110 between the plurality of projections 138. During the threading, thread guides 118 simultaneously dispense respective continuous threads 122 such that continuous threads 122 are wound around the plurality of projections 138 to form a thread layer 124 comprising a plurality of thread lines, with each thread line extending between two respective projections 138 of the plurality of projections 138 and across winding field 142. In some embodiments, winding the continuous threads 122 comprises moving the winding head 110 relative to the projection 138 set and across winding field 142. In some embodiments, winding the continuous threads 122 comprises moving the projection 138 set relative to winding head 110 such that winding head 110 move across winding field 142.

In some embodiments, the plurality of continuous threads 122 forming thread layer 124 can be a first set of continuous threads 122. In some embodiments, a method of manufacturing an article of apparel can further comprise threading a second set of continuous threads 122 onto the plurality of projections 138 over the first set of continuous threads 122 by passing the plurality of thread guides 118 on the winding head 110 between the plurality of projections 138. During the threading of the second set of continuous threads, thread guides 118 can simultaneously dispense the respective second continuous threads 122 such that the second continuous threads 122 are wound around the plurality of projections 138 to form a second thread layer 124 over the first thread layer 124. The second thread layer can comprise a plurality of second thread lines, with each second thread line extending between two respective projections 138 of the plurality of projections 138 and across the winding field 142.

In some embodiments, system 100 can further comprise a Z-direction actuator 117. In such embodiments, Z-direction actuator 117 can move thread guides 118 parallel to a Z axis defined perpendicular to the lateral plane that includes the X axis and Y axis. In some embodiments, the Z-direction actuator 117 can move winding head 110 parallel to the Z axis. In some embodiments, system 100 can additionally or alternatively comprise a Z-direction actuator configured to move the plate 130 parallel to the Z axis.

In some embodiments, system 100 can comprise a rotation actuator 119 that rotates the winding head 110 about a rotation axis. The rotation axis can be parallel to the Z axis, and the rotation axis can therefore perpendicular to the lateral plane. Because rotation actuator 119 can rotate winding head 110 about the rotation axis the rotation, actuator 119 can simultaneously rotate each of thread guides 118 on winding head 110 relative to the rotation axis. The simultaneous rotation of thread guides 118 on winding head 110 can preserve the positions of the thread guides 118 among the plurality of thread guides 118 relative to one another as the winding head 110 rotates.

System 100 can comprise a control system for controlling X-direction actuator 111, a Y-direction actuator 115, Z-direction actuator 117, and/or rotation actuator 119. In some embodiments, the control system can comprise a computer system such as computer system 300 shown in FIG. 8, though the control system need not comprise all components shown in FIG. 8. The control system can comprise a programmable memory (for example, main memory 308 and/or second memory 310). The programmable memory can store computer programs that can direct the X-direction, Y-direction, Z-direction, and/or rotation direction of the actuators, and therefore the X-direction, Y-direction, Z-direction, and/or rotation direction movement of winding head 110 relative to plate 130. For example, the programmable memory can store computer programs that instruct the actuators to operate at certain conditions. In the case of rotation actuator 119, the conditions can comprise rate of rotation and direction of rotation. In the case of X-direction actuator 111, a Y-direction actuator 115, and/or Z-direction actuator 117, the conditions can comprise rate of translation and direction of translation.

In some embodiments, these conditions can be set by a programmer of the control system specifying angular and linear positions (and/or angular and translation velocities) of plate 130 and/or winding head 110, respectively, at various times or in various chronological orders. In some embodiments, the programmer can specify these angular and linear positions (and/or angular and translation velocities) in one or more files. In some embodiments, the one or more files can comprise a file describing the positions of projections 138 in three dimensions (3D). In such embodiments, each of projections 138 can be associated with a unique identifier (e.g., a number or alphanumeric code) that is specified in the file. In some embodiments, the one or more files can be JSON files, but the one or more files are not limited to a particular format. In further embodiments, the one or more files can be a vector based file format, such as, for example, .dxf files. In some embodiments, one or more processors in the control system (for example, processor 304) can interpret the contents of the one or more files into CNC G-code commands that control the actuators to move plate 130 and winding head 110 relative to each other. In some embodiments, the contents of the one or more files can also comprise instructions to change a continuous thread to another continuous thread, for example, to transition between winding a first thread layer and winding a second thread layer. In some embodiments, the programming may comprise specifying the order in which continuous threads should be wound around projections 138, for example, using the unique identifiers associated with projections 138.

As shown for example in FIG. 1A, system 100 can comprises a plurality of spools 126. Each of the continuous threads 122 extends from a respective spool 126 among the plurality of spools 126 such that dispensing the respective continuous threads unwinds the plurality of spools 126. In some embodiments, each spool 126 among the plurality of spools 126 is biased toward winding a corresponding one of the respective threads about the spool 126. In some embodiments, a first spool 126 of the plurality of spools 126 comprises a first thread type and a second spool 126 of the plurality of spools 126 comprises a second thread type different from the first thread type. Thus, in some embodiments, different types of continuous thread 122 can be fed to different thread guides 118 of winding head 110. Winding head 110 may thereby deposit a variety of types of continuous thread 122 simultaneously within a thread layer 124.

In some embodiments, multiple continuous threads 122 from multiple spools 126 can be fed to a single thread guide 118. Thus, in such embodiments, a single thread guide 118 can simultaneously dispense multiple overlaying continuous threads 122. In some such embodiments, a single thread guides 118 can simultaneously dispense multiple continuous threads 122 of different types. In some embodiments, continuous threads 122 from two spools 126, three spools 126, four spools 126, or any other plural number of spools 126 can be fed to a single thread guide 118.

FIG. 1B illustrates a spacing of thread guides 118 within the plurality of thread guides 118 relative to one another according to some embodiments. Thread guides 118 each have a footprint size 154 defined by the greatest distance across the thread guide 118 parallel to the lateral plane at a dispensing end of the thread guide 118. In some embodiments, the dispensing end of thread guides 118 can have a cylindrical shape and extend perpendicular to the lateral plane. In such embodiments, the footprint size 154 can be the diameter of the cylindrical shape. Each thread guide 118 can have a footprint size 154 defined by the effective dimeter of the dispensing end of the thread guide. An effective diameter of a circular dispensing end shape is the diameter of the shape. An effective diameter of a non-circular dispensing end shape is intended to refer to the maximum cross-sectional dimension of the shape. For example, the effective diameter of a dispensing end having a square cross-sectional shape would be the diagonal dimension across the square. As another example, the effective diameter of a dispensing end having an oval cross-sectional shape would be the length of the oval-shape's major axis.

As illustrated in FIG. 1B, projections 138 can be spaced apart from each other by a projection gap size 153, defined as a size of gaps between adjacent projections 138 of plate 130. Projection gap size 153 can be at least as large as footprint size 154 to allow dispensing ends of the thread guides 118 to fit between adjacent projections 138. This allows dispensing ends of the thread guides 118 to pass between projections 138 and wind continuous threads about projections 138.

Further, as illustrated in FIG. 1B, thread guides 118 can be spaced on winding head 110 by a thread guide gap size 158, defined as a size of gaps between adjacent dispensing ends of thread guides 118 of winding head 110. Thread guide gap size 158 can be at least large enough to enable projections 138 to pass between adjacent thread guides 118. This allows multiple thread guides 118 to pass between different pairs of adjacent projections 138 simultaneously (as shown for example in FIG. 3B) to simultaneously wind continuous threads 122 about multiple projections 138.

Further, thread guides 118 can be spaced apart from each other on winding head 110 by a thread guide spacing distance 156 defined as a distance between center points of adjacent thread guides 118 measured in a direction parallel to the transverse plane. In some embodiments, thread guide spacing distance 156 can be substantially equal to a projection spacing distance 157 defined as a distance between center points of adjacent projections 138. As used herein, "substantially equal" means that (i) a first and second distance or size are exactly equal to each other or (ii) a first distance/size is equal to a second distance/size with a tolerance of +/−10% of the first distance/size. For example, a distance of 1.1 centimeters is substantially equal to 1 centimeter.

In embodiments comprising a thread guide spacing distance 156 and projection spacing distance 157 that are substantially equal, aligning one thread guide 118 with one gap between a pair of adjacent projections 138 can also align other thread guides 118 with other gaps between other pairs of adjacent projections 138 on a same side of winding field 142. The substantially equal sizes of thread guide spacing distance 156 and projection spacing distance 157 can thereby facilitate passing thread guides 118 between multiple pairs of adjacent projections 138 simultaneously to wind multiple continuous threads 122 about different projections 138 simultaneously (as shown for example in FIG. 3B).

As also shown in FIG. 1B, the plurality of thread guides 118 can be coupled to winding head 110 within an area that spans a Y-span distance 150 and an X-span distance 152. In embodiments comprising thread guides 118 arranged in a single linear, evenly spaced row extending parallel to the Y axis, Y-span distance can be substantially equal to the footprint size 154 added to the product of the total number of thread guides 118 and thread guide spacing distance 156. However, the relationship between Y-span distance 150, the total number of thread guides 118, footprint size 154, and thread guide spacing distance 156 can differ in other embodiments according to the shape of thread guides 118 and the arrangement of thread guides 118. Further, in embodiments comprising thread guides 118 arranged in a single linear, evenly spaced row extending parallel to the Y axis, X-span distance 152 can be substantially equal to footprint size 154. However, the relationship between X span distance 152, the total number of thread guides 118, footprint size 154, and thread guide spacing distance 156 can differ in other embodiments according to the shape of thread guides 118 and the arrangement of thread guides 118.

Figure 4B:
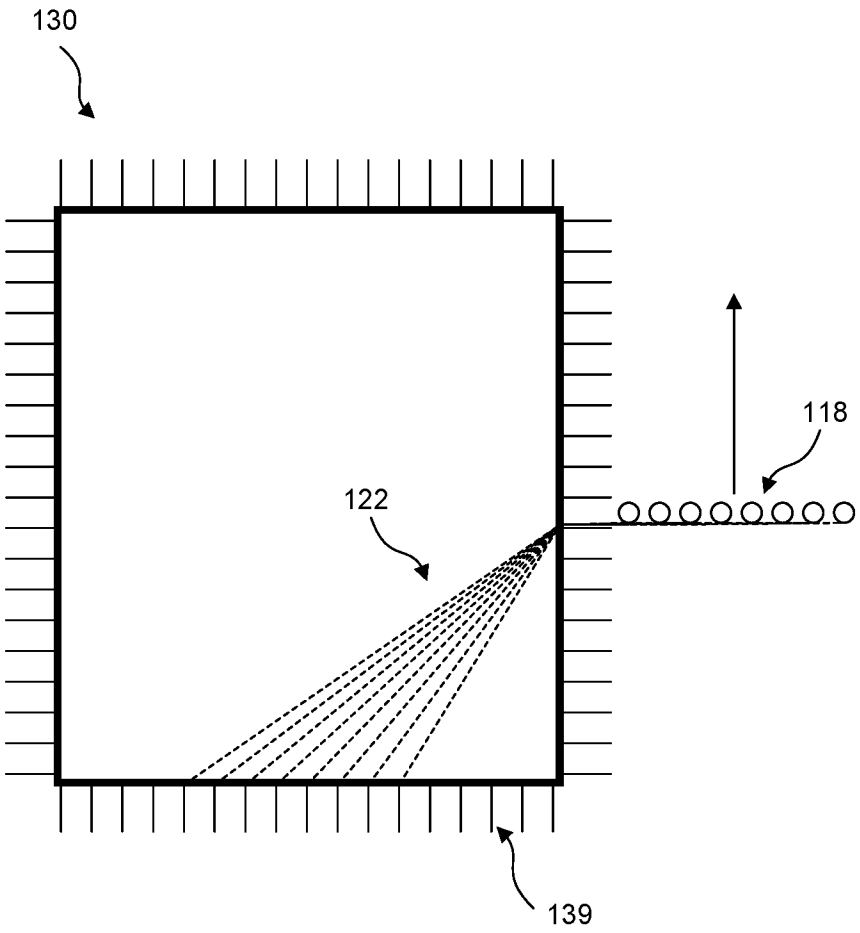
FIGS. 4A-4D illustrate steps in a winding method according to some embodiments.

Any collection of thread guides 118 spanning an X-span distance 152 less than projection gap size 153 can pass sequentially between a single pair of two adjacent projections 138 by translating in a straight line between the two adjacent projections 138. Thus, for example as illustrated in FIG. 4B, the entire plurality of thread guides 118 can pass between a single pair of two adjacent projections 138 by translating parallel to the Y axis because X-span distance 152 is less than projection gap size 153.

Figure 2:
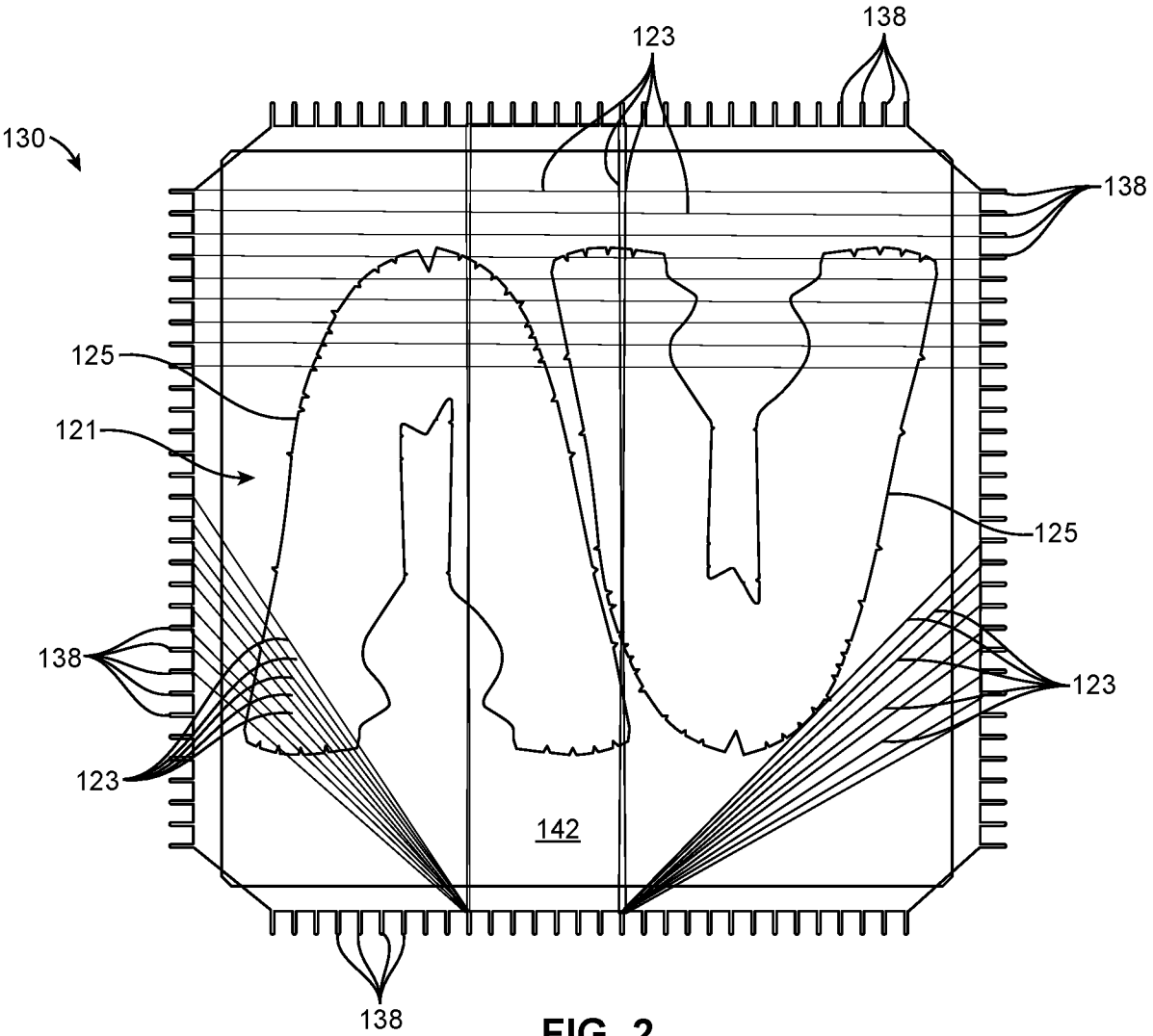
FIG. 2 illustrates a thread pattern according to some embodiments.

As shown for example in FIG. 2, completing a winding of one or more thread layers 124 can create a thread pattern 121 on plate 130. Thread pattern 121 comprises at least one thread layer 124. Each thread layer 124 of thread pattern 121 is formed of a plurality of thread lines 123 with each thread line 123 extending between two respective projections 138 of the plurality of projections 138 and across the winding field 142.

In some embodiments, a method of manufacturing an article of apparel using system 100 can comprise bonding the threads 122 within a thread layer 124 or thread pattern 121. The method can thus comprise bonding the threads 122 within the thread layer 124 or thread layers 124 that make up the thread pattern 121. Bonding threads 122 can comprise any processes for joining or interlinking threads as appropriate for an intended application. Accordingly, bonding threads 122 according to some embodiments can comprise, for example, baking threads 122, heat fusing threads 122, heat pressing threads 122, applying a bonding agent to threads 122, or any combination of the foregoing.

In some embodiments, a method of manufacturing an article of apparel using system 100 can comprise cutting at least a portion of a thread layer 124 or thread pattern 121 from the plurality of projections 138. The method can thus comprise cutting at least a portion 125 of the thread layer 124 of thread layers 124 that make up thread pattern 121 from the plurality of projections 138. In some embodiments, the method can comprise cutting two separate portions 125 from a thread layer or thread pattern 121. In some embodiments, the method can comprise cutting two separate portions 125 from the thread layer 124 or thread layers 124 that make up thread pattern 121. In some embodiments, the portion or each of the two separate portions 125 can define at least a portion of an article of apparel. In some embodiments, the article of apparel can be an upper for an article of footwear.

Figures 3A, 3B, 3C:
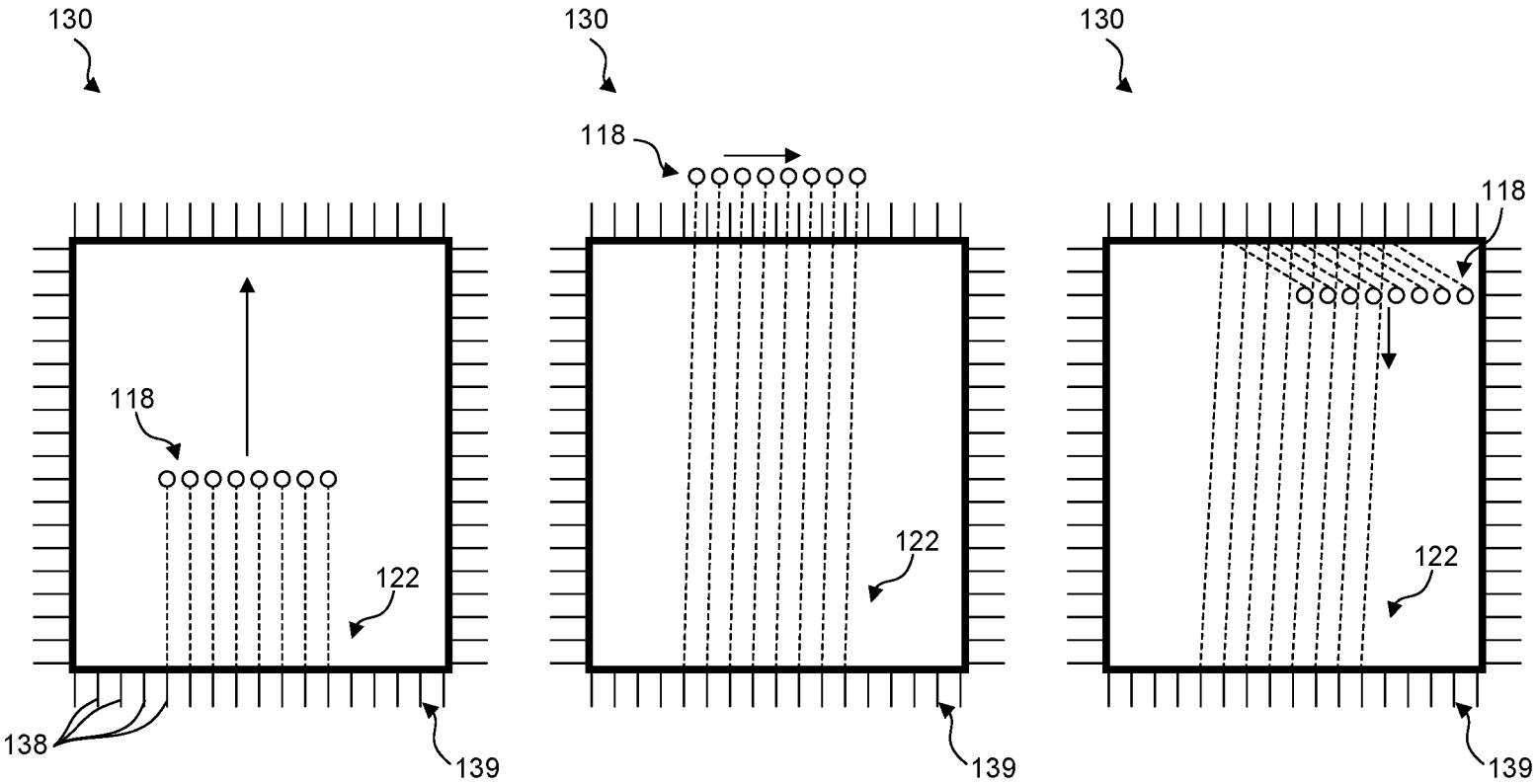
FIGS. 3A-3C illustrate steps in a winding method according to some embodiments.

FIGS. 3A-3C illustrate steps in a method of manufacturing an article of apparel with system 100 according to some embodiments. In FIG. 3A, with continuous threads 122 fixed relative to one or more projections 138 of a plate 130, winding head 110 moves relative to plate 130 to move thread guides 118 across the lateral plane. System 100 threads the plurality of continuous threads in a passing step occurring in the transition from FIG. 3A to FIG. 3B, wherein respective continuous threads 122 are each passed through a respective gap defined between a respective pair of adjacent projections 138 among the projection 138 set provided by plate 130. In the illustrated example, the respective continuous threads 122 are each passed through the respective gap simultaneously. The passing step can also comprise passing at least the dispensing end of each thread guide 118 among the plurality of thread guides 118 through a respective one of the respective gaps between respective pairs of adjacent projections 118. As shown by the transition from FIG. 3B to FIG. 3C, the passing step can be a first passing step followed by a second passing step wherein the thread guides 118 and continuous threads 122 each pass through respective gaps defined between different pairs of projections 138 immediately adjacent to the first pairs of projections 138 in the first passing step to wrap the continuous threads 122 around projections 138.

To wrap continuous threads 122 around further projections, the second passing step shown in FIGS. 3A-3C can be followed an another first passing step and second passing step as illustrated in FIGS. 3B and 3C. Any number of first and second passing steps as illustrated in FIGS. 3B and 3B can be performed during winding of a thread layer or thread pattern.

Figure 4A:
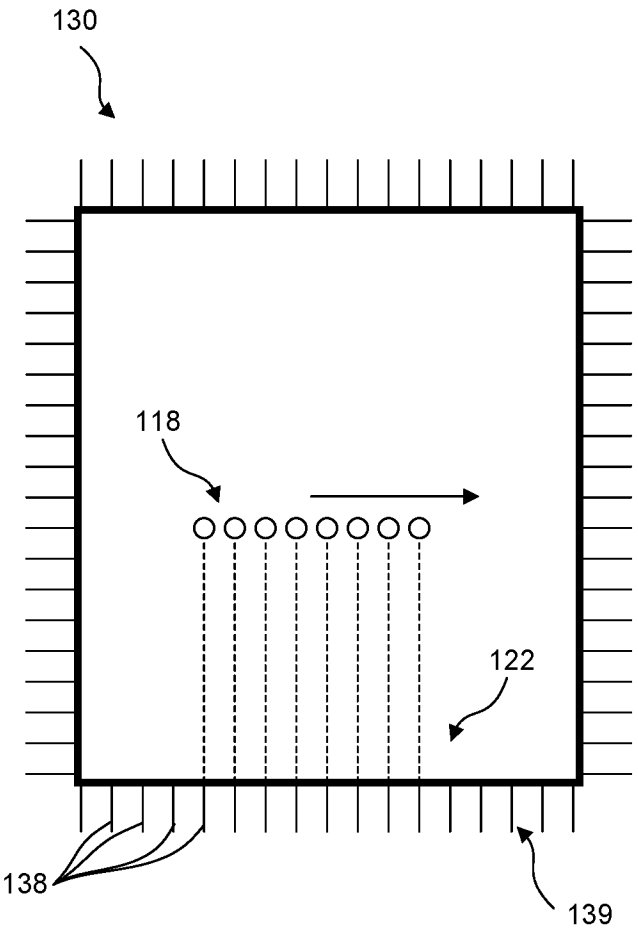

Alternatively, the second passing step shown in FIGS. 3A-3C can be followed by a passing step wherein every continuous thread 122 among the plurality of continuous threads 122 is passed through a single gap defined between a single pair of adjacent projections 138 among the projection 138 set as shown in the transition from FIG. 4A to FIG. 4B. Any number of first and second passing steps as illustrated in FIGS. 3B and 3B and any number of passing steps as illustrated in FIGS. 4A and 4B can be performed during winding of a thread layer or thread pattern. The number and order of these steps can be tailored to wind a desired thread layer or thread pattern.

FIGS. 4A-4D illustrate steps in a method of manufacturing an article of apparel with system 100 according to some embodiments. In FIG. 4A, with continuous threads 122 fixed relative to one or more projections 138 of a plate 130, system 100 threads the plurality of continuous threads in a passing step occurring in the transition from FIG. 4A to FIG. 4B, wherein every continuous thread 122 among the plurality of continuous threads 122 is passed through a single gap defined between a single pair of adjacent projections 138. In such embodiments, the passing step can comprise passing every continuous thread 122 through the single gap sequentially.

In some embodiments, winding head 110 can then move to reposition thread guides 118. In some embodiments, winding head 110 can then move to reposition thread guides 118 as shown in FIG. 3B for a passing step as illustrated in FIGS. 3B and 3C where respective continuous threads 122 are each passed through the respective gap simultaneously. Alternatively, in some embodiments winding head 110 can then move to reposition thread guides 118 as shown, for example, in FIG. 4C. In such embodiments, to wrap the continuous threads 122 around one or more projections 138, the passing step occurring at the transition from FIG. 4A to FIG. 4B can then be followed by another passing step shown by the transition between FIG. 4C and FIG. 4D wherein every continuous thread 122 among the plurality of continuous threads 122 is passed through a single gap defined between a different single pair of adjacent projections 138 than the pair between which the continuous threads 122 passed in the preceding passing step of FIGS. 4A and 4B.

Figure 4D:
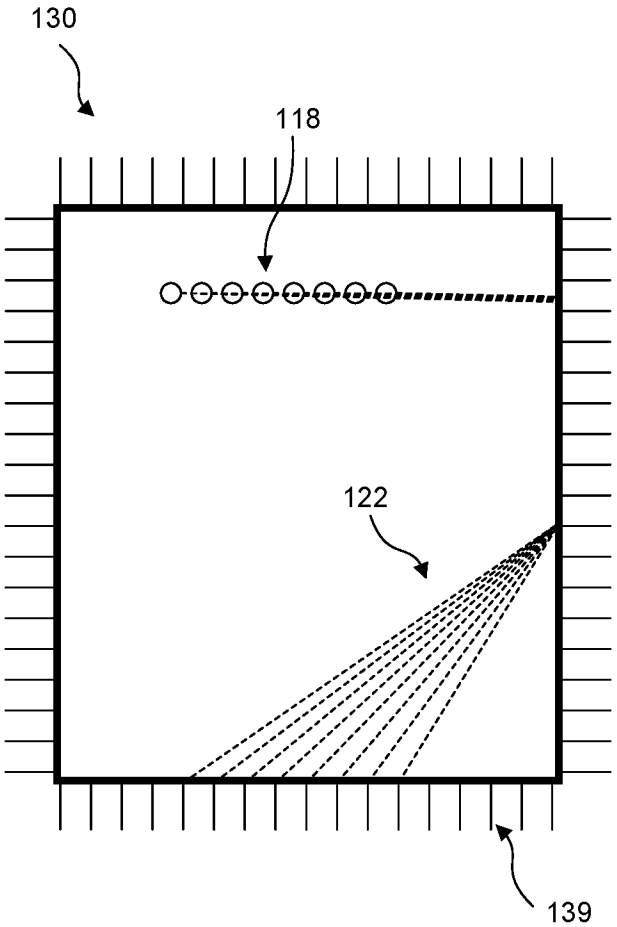
Figure 4C:
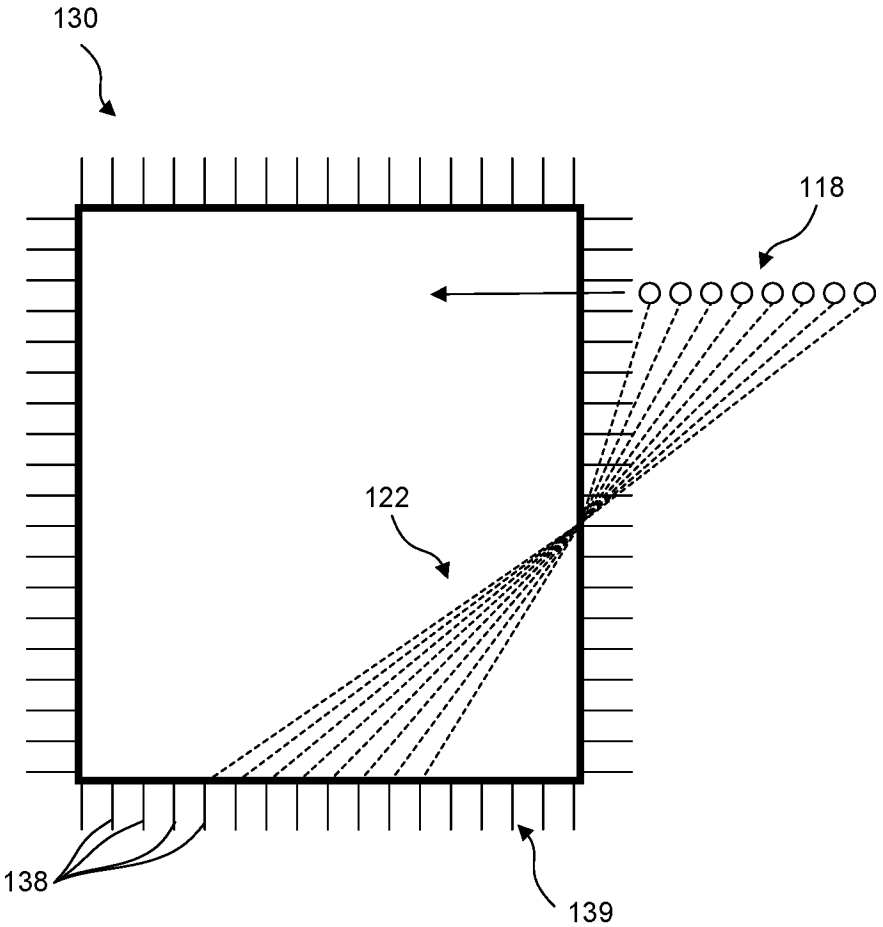

Any number of first and second passing steps as illustrated in FIGS. 3B and 3B, any number of passing steps as illustrated in FIGS. 4A and 4B, and any number of passing steps as illustrated in FIGS. 4C and 4D can be performed during winding of a thread layer or thread pattern. The number and order of these steps can be tailored to wind a desired thread layer or thread pattern. In some embodiments, performing multiple consecutive passing steps as illustrated in FIGS. 4C and 4D can form overlaying thread lines that follow the same path between two respective projections 138.

Figure 5B:
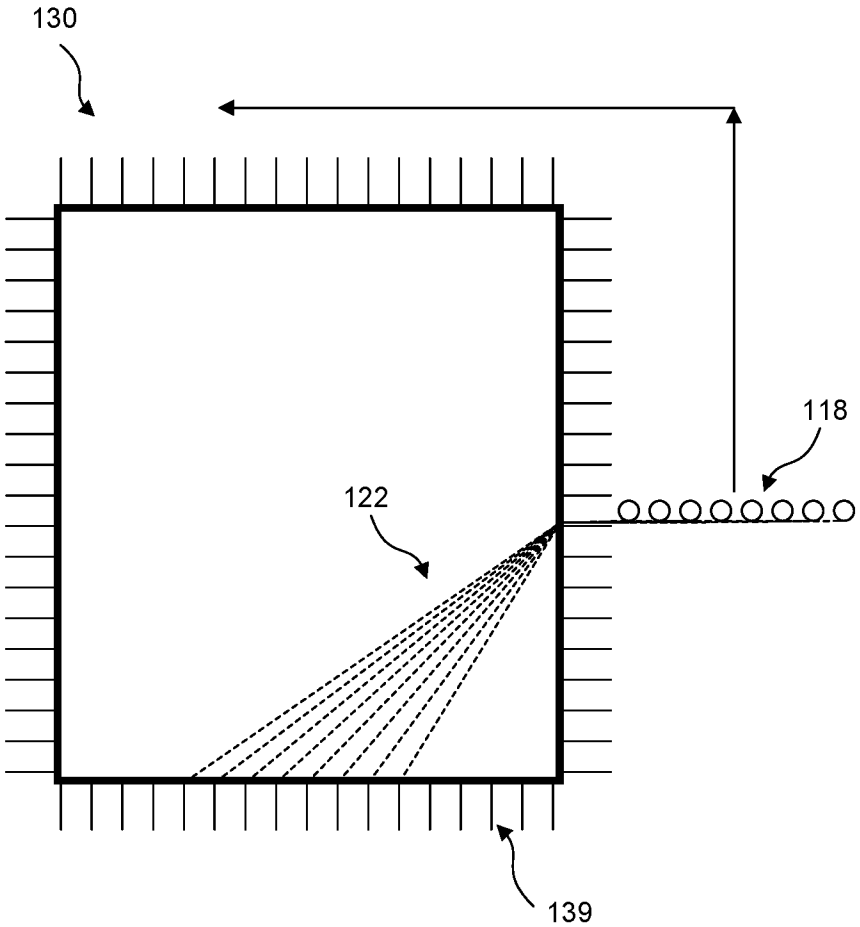
FIGS. 5A-5D illustrate steps in a winding method according to some embodiments.
Figure 5A:
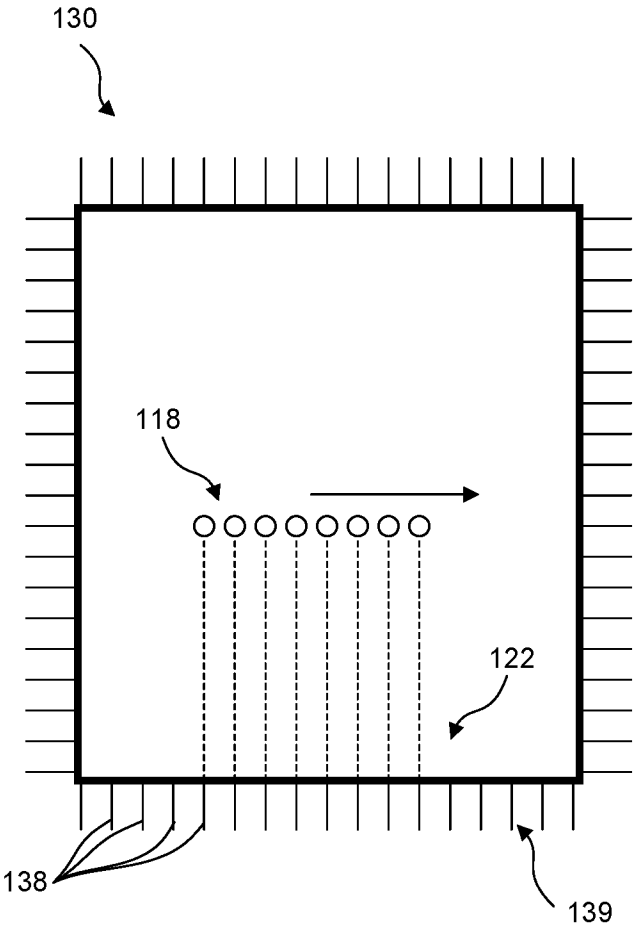
Figure 5D:
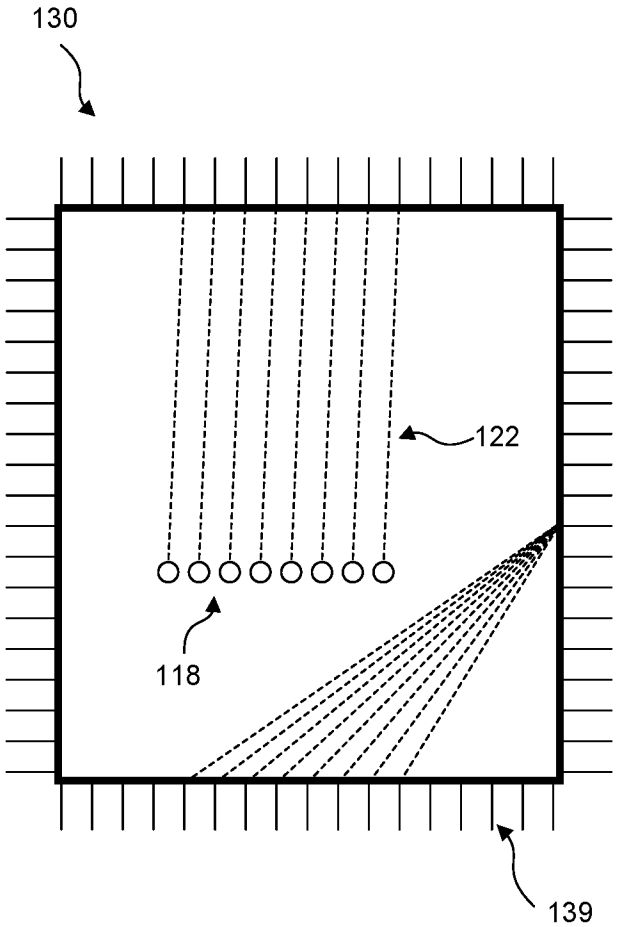

FIGS. 5A-5D show how passing steps of different kinds can be applied within a method for winding of a thread layer or thread pattern according to some embodiments. In FIG. 5A, with continuous threads 122 fixed relative to one or more projections 138 of a plate 130, system 100 threads the plurality of continuous threads in a passing step occurring in the transition from FIG. 5A to FIG. 5B, wherein every continuous thread 122 among the plurality of continuous threads 122 is passed through a single gap defined between a single pair of adjacent projections 138. In some embodiments, the passing step can comprise passing every continuous thread 122 through the single gap sequentially.

Figure 5C:
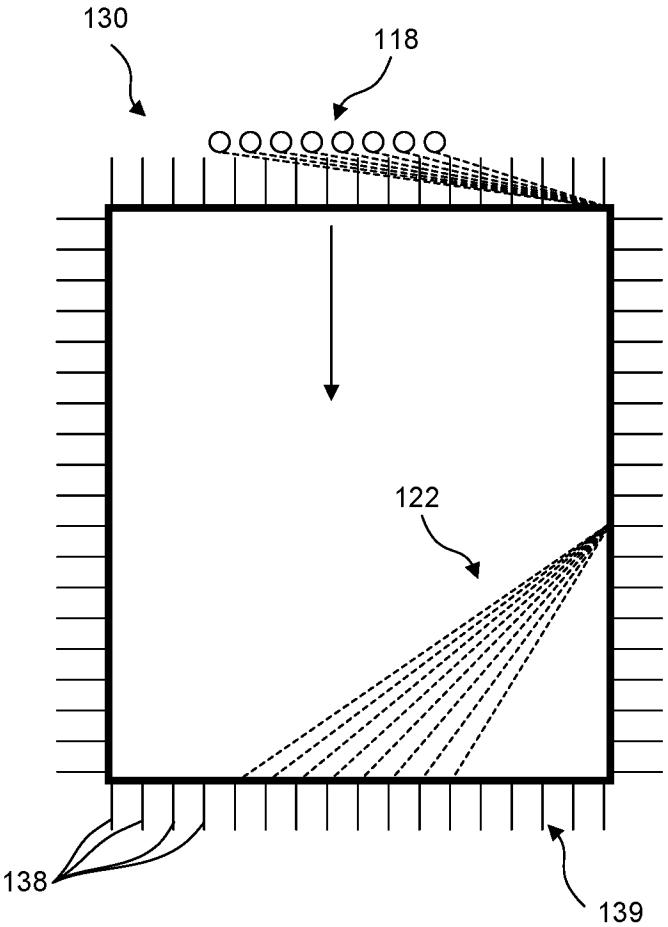

Winding head 110 can then move to reposition thread guides 118 adjacent to a different side of plate 130 as shown, for example, in FIG. 5C. System 100 then threads the plurality of continuous threads in a second passing step occurring in the transition from FIG. 5C to FIG. 5D, wherein respective continuous threads 122 are each passed through a respective gap defined between a respective pair of adjacent projections 138 among the projection 138 set provided by plate 130. In the illustrated embodiment, the respective continuous threads 122 are each passed through the respective gap simultaneously. In such embodiments, the second passing step comprises passing at least the dispensing end of each thread guide 118 among the plurality of thread guides through a respective one of the respective gaps between respective pairs of adjacent projections 138.

The passing steps illustrated in FIGS. 5A-5D can be repeated multiple times in any order. For example, a first passing step wherein respective continuous threads 122 are each passed simultaneously through the respective gaps defined between different pairs of adjacent projections 138 as shown in the transition from FIG. 5C to FIG. 5D can be followed by a second passing step wherein every continuous thread 122 is passed sequentially through a single gap defined between a single pair of adjacent projections 138 as shown in the transition from FIG. 5A to FIG. 5B.

Figure 6A:
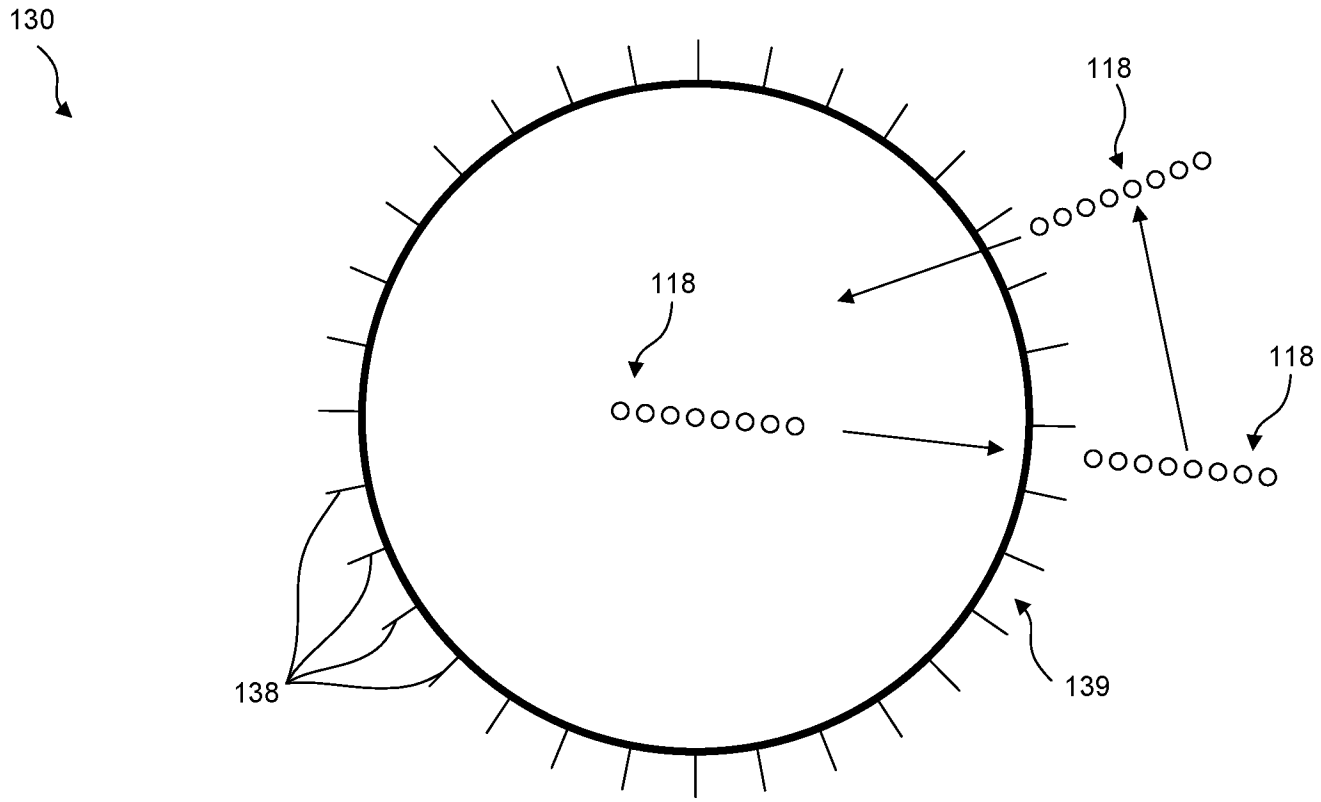
FIG. 6A illustrates steps in a winding method according to some embodiments.

As shown in FIG. 6A, in some embodiments a method of manufacturing an article of apparel with system 100 can comprise rotating winding head 110 on the rotation axis between a first passing step and a second passing step. In some embodiments, winding head 110 can be rotated outside of winding field 142 before or after a passing step as described herein. As shown, in some embodiments every thread guide 118 can be passed through projections 138 prior to thread guides 118 being rotated and repositioned. After rotating and repositioning thread guides 118, every thread guide 118 can be passed through projections 138 again.

As also shown in FIG. 6A, in some embodiments, plate 130 can differ in shape according to differing embodiments. Thus, whereas plates 130 as shown in FIGS. 1A-5D have rectangular shapes, plate 130 of FIG. 6A has a circular shape. Plates 130 of non-circular shapes can be used in methods wherein winding head 110 rotates on the rotation axis or wherein winding head 110 does not rotate. Similarly circular plates 130 can be used in methods wherein winding head 110 rotates on the rotation axis or wherein winding head 110 does not rotate.

Figure 6C:
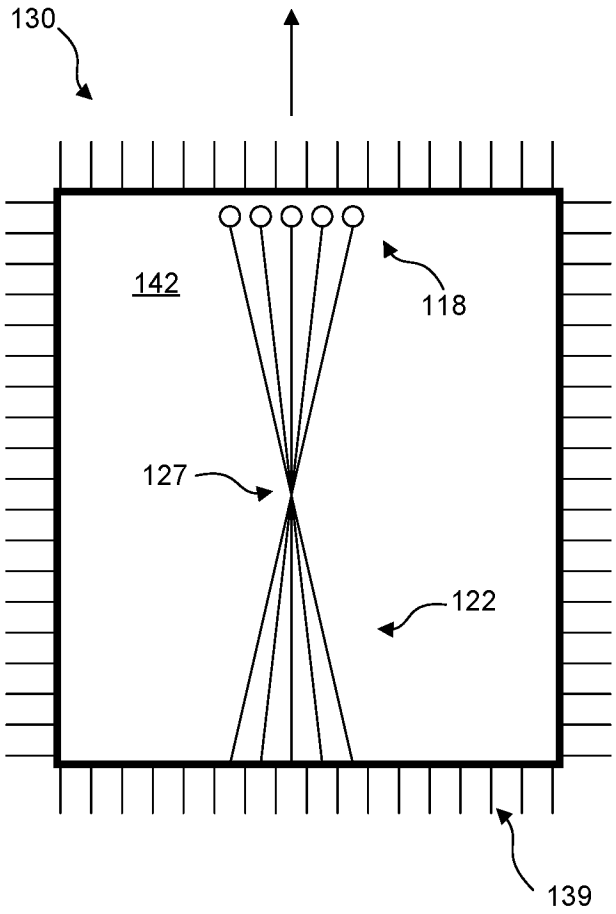
FIGS. 6B and 6C illustrate steps in a winding method according to some embodiments.
Figure 6B:
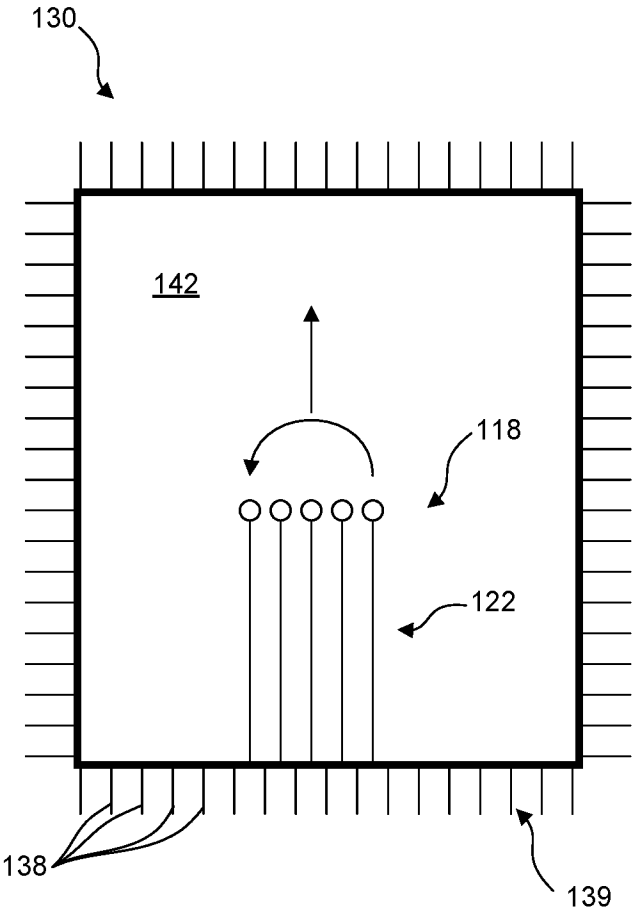

In some embodiments, as shown for example in FIGS. 6B and 6C, winding head 110 can be rotated while positioned over winding field 142. In such embodiments, winding head 110 can be rotated over winding field 142 before or after a passing step as described herein. In some embodiments, winding head 110 can be rotated by 180 degrees or more. Rotating winding head 110 by 180 degrees or more can create an overlap point 127 where multiple threads 122 are twisted about one another and thus overlap. In some embodiments, during a method as described herein, winding head 110 can be rotated one or more times outside of winding field 142 and one or more times over winding field 142.

Thread patterns 124 as described herein can each comprise multiple thread layers, such as thread layers 200 and 220 described in further detail below. The winding steps described above with regard to system 100 can be implemented according to details described below with regard to the thread layers 200 and 220. Thread layers as described herein (for example, thread layers 200 and 220) can each comprise a thread border 250 defined by the space in which thread lines of the thread layer are located. The thread border 250 for a thread layer is the space in which thread lines of the thread layer are located after the thread layer is removed (for example, cut) from anchor points used to wind the thread layer. Each anchor point can be a projection, such as projection 138, within a projection set 139 described above. A plurality of thread lines within a thread pattern can comprise a first end located at a first side of the thread border 250 and a second end located at a second side of the thread border 250. For example, thread lines 204 of thread layer 200 can comprise a first end 210 located at a first side of thread border 250 and a second end 212 located at a second side of thread border 250.

Figure 7A:
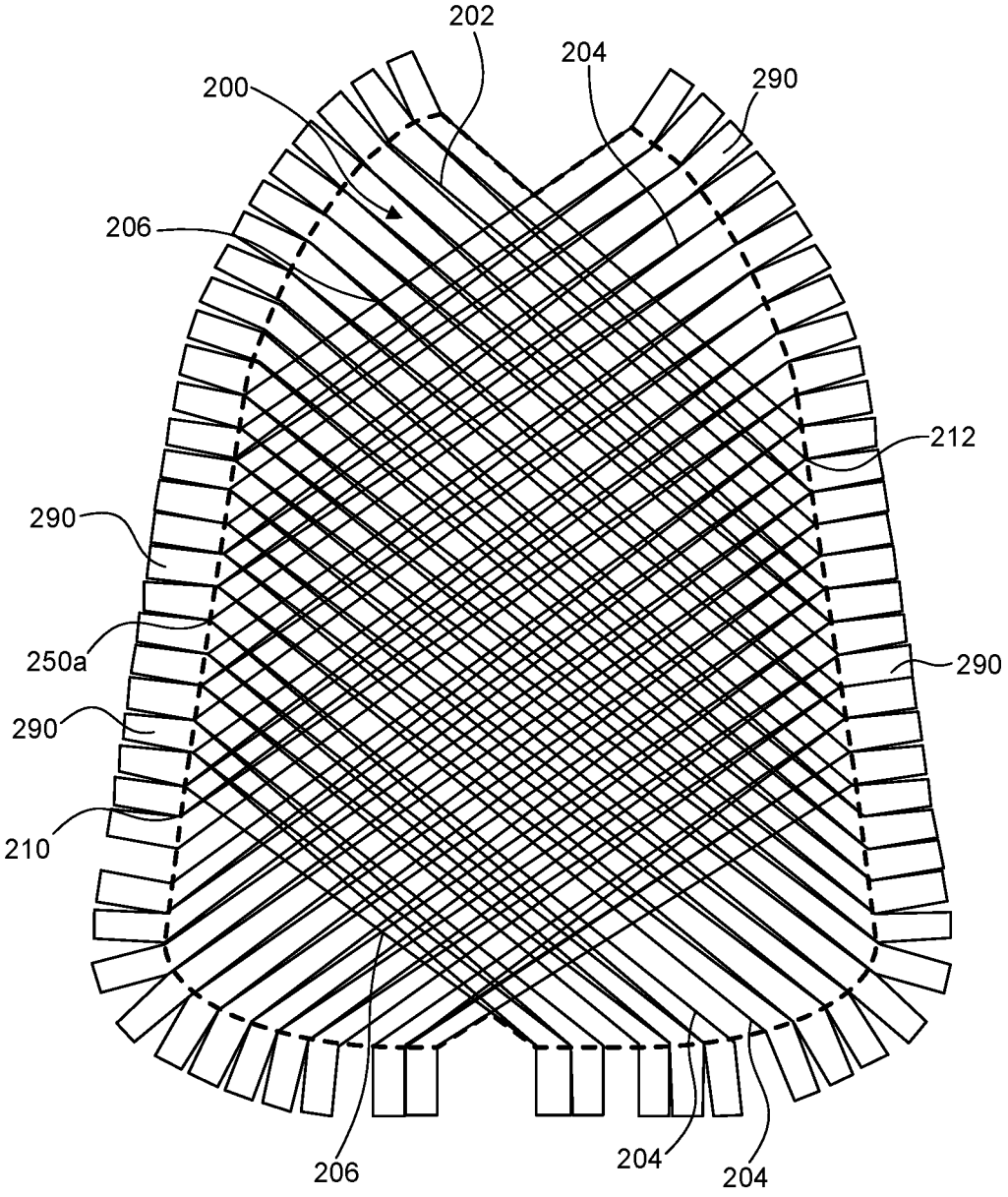
FIGS. 7A and 7B show thread layers according to some embodiments.
Figure 7B:
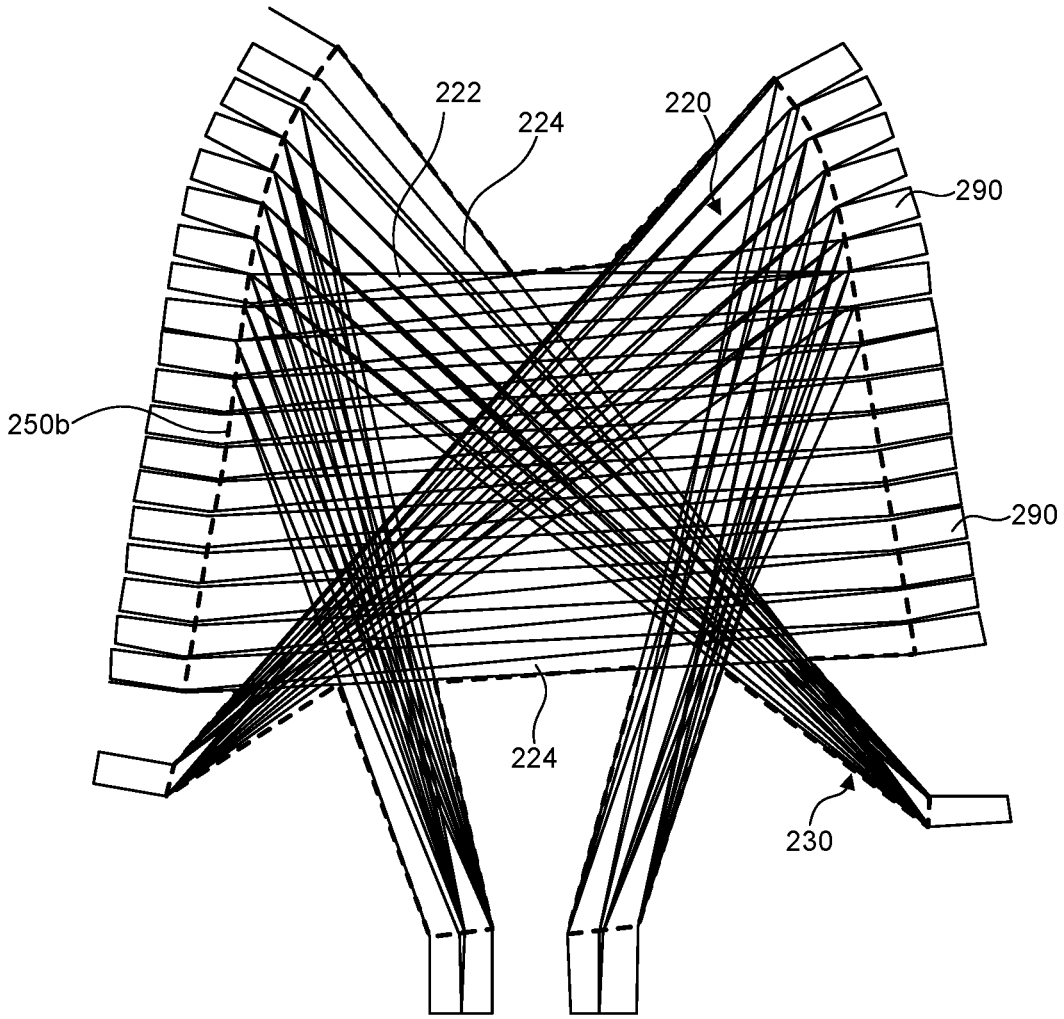

FIGS. 7A and 7B illustrate thread borders 250*a-b* for thread layers 200 and 220. For a thread pattern comprising a plurality of thread layers, the thread pattern can comprise a thread pattern border 250 defined by the space occupied by the combination of the individual thread layers.

As used herein, sides of a perimeter edge or a border refer to top, bottom, right, and left sides of a shape defined by the edge or border. The top, bottom, right, and left sides of the shape are located to the top, bottom, right, and left of a geometrical center of the shape. So, a perimeter edge or border will have a top side defined by the portion of the edge located above the geometrical center, a bottom side defined by the portion of the edge located below the geometrical center, a right side defined by the portion of the edge or border located to the right of the geometrical center, and a left side defined by the portion of the edge or border located to the left of the geometrical center. The top and bottom sides do not overlap. Similarly, the left and right sides do not overlap. The top and left sides overlap at the portion of the edge or border located to the top-left of the geometrical center. The top and right sides overlap at the portion of the edge or border located to the top-right of the geometrical center. The bottom and left sides overlap at the portion of the edge or border located to the bottom-left of the geometrical center. The bottom and right sides overlap at the portion of the edge or border located to the bottom-right of the geometrical center. For purposes of determining the shape defined by the perimeter edge or border, the material having the edge or border is laid in a flat configuration with no portion of the material overlapping itself.

As used herein, a first side of a perimeter edge or border can be the top, bottom, right, or left side of the edge or border and a second side of the perimeter edge can be the top, bottom, right, or left side of the edge or border, provided that the first and second sides are not the same side. Similarly, a third side of a perimeter edge or border can be the top, bottom, right, or left side of the edge or border and a fourth side of the edge or border can be the top, bottom, right, or left side of the edge or border, provided that the third and fourth sides are not the same, and are not the same as the first or second sides.

In some embodiments, one or more thread layers (for example, thread layers 200 and 220) can comprise a thread defining (i) a plurality of thread lines (for example, thread lines 204 and 224) each extending from a first side of a thread border to a second side of the thread border and crossing over each other at points of overlap between two or more of the thread lines, and (ii) a plurality of thread lines each extending from a third side of the thread border to a fourth side of the thread border and crossing over each other at points of overlap between two or more of the thread lines. The thread lines extending from the first side to the second side can extend continuously from the first side to the second side, and the thread lines extending from the third side to the fourth side can extend continuously from the third side to the fourth side.

Thread layer 200 comprises a continuous thread 202 wound around anchor points 290. Thread layer 220 comprises a continuous thread 222 wound around anchor points 290. In some embodiments, anchor points 290 can be different sets of anchor points around which different thread layers are wound. In some embodiments, a plurality of thread layers can wound around the same set of anchor points 290. In such embodiments, separate thread layers can be wound over each other, with one thread layer disposed over one or more other thread layers.

As used herein, "anchor point" means a location to which a thread or group of thread lines is fixedly attached. Each anchor point can be provided by a projection 138 described above. A thread or thread line can be wrapped, wound, bonded, or otherwise attached at an anchor point. In some embodiments, an anchor point can be a location on an article of apparel. For example, an anchor point can be a hole or opening left behind by a structure (for example, pin, projection, or nub) used to wind continuous thread(s) of a thread layer and/or thread pattern. In some embodiments, a thread layer or thread pattern for an article of apparel may not comprise any anchor point locations because all the anchor point locations present during winding of the thread layer or thread pattern have been removed (for example, cut off). An anchor point can be a structure (for example, pin, projection, or nub) used to wind continuous thread(s) of a thread layer and/or thread pattern. And the anchor point structure may or may not form a portion of a thread layer or thread pattern for an article of apparel.

A continuous thread wrapped or wound around an anchor point need not be wrapped or wound completely (i.e., 360 degrees) around the anchor point. A continuous thread wrapped or wound around an anchor point can be wrapped or wound around only a portion of the anchor point. For example, a continuous thread wrapped or wound around an anchor point can be wrapped or wound around 25% (90 degrees) of an anchor point's perimeter, 50% (180 degrees) of an anchor point's perimeter, 75% (270 degrees) of an anchor point's perimeter, or 100% (360 degrees) of an anchor point's perimeter. In some embodiments, a continuous thread can be wrapped or wound around an anchor point's perimeter more than once before being threaded to the next anchor point. For example, a continuous thread can be wrapped or wound around an anchor point's perimeter one and a half times (540 degrees) or twice (720 degrees) before being threaded to the next anchor point.

Continuous thread 202 can be wrapped around a plurality of anchor points 290 and comprises a plurality of thread lines 204. Each thread line 204 extends between two respective anchor points 290.

Continuous thread 202 can be wrapped around a plurality of anchor points 290 in tension such that individual thread lines 204 are in tension when wrapped around anchor points 290. In some embodiments, the tension at which thread lines 204 are wound can range from 0 centinewtons (CN) to 25 cN, including subranges. For example, in some embodiments, the tension at which thread lines 204 are wound can range from 0.01 cN to 25 cN, from 0.1 cN to 25 cN, from 1 cN to 25 cN, from 5 cN to 25 cN, from 10 cN to 25 cN, or from 15 cN to 25 cN. In some embodiments, the tension at which thread lines 204 are wound can range from 2 cN to 10 cN. In some embodiments, the tension at which thread lines 204 are wound can range from 2 cN to 6 cN.

The number of thread lines 204 for thread layer 200 fixed at an anchor point 290 is defined by the "thread line communication number" of an anchor point 290. As used herein, "thread line communication number" means the number of thread lines extending from an anchor point to different anchor points. Two thread lines extending between the same two anchor points (i.e., overlaying thread lines) only counts as "1" for purposes of calculating a thread line communication number for the anchor points. For example, a thread line communication number of five means that an anchor point has five thread lines extending from it with each of the five thread lines leading to another, different anchor point. As another example, a thread line communication number of six means that an anchor point has six thread lines extending from it with each of the six thread lines leading to another, different anchor point.

Similarly, the number of thread lines fixed at an anchor point 290 for a thread pattern comprising a plurality of thread layers is defined by the "thread line communication number" of an anchor point 290 for the thread pattern. For a thread pattern, the "thread line communication number" of an anchor point 290 is the total number of thread lines, for the plurality of layers, extending from an anchor point to different anchor points.

Anchor points 290 can have a thread line communication number of "X" or more for a thread layer or a thread pattern. In some embodiments, two or more respective anchor points 290 can have a thread line communication number of "X" or more. In some embodiments, all the anchor points 290 for a thread layer or a thread pattern can have a thread line communication number of "X" or more. "X" can be, for example, 2, 3, 4, 5, 6, 7, 8, 9, 10, 15, 20, 25, 30, 35, 40, 45, or 50, within a range having any two of these values as end points. For example, in some embodiments "X" can be in a range of 2 to 50, 3 to 50, 4 to 50, 5 to 50, 6 to 50, 7 to 50, 8 to 50, 9 to 50, 10 to 50, 15 to 50, 20 to 50, 25 to 50, 30 to 50, 35 to 50, 40 to 50, or 45 to 50. In some embodiments, "X" can be greater than 50. In some embodiments, "X" can range from 2 to 100, 10 to 100, or 20 to 100. In some embodiments, "X" can range from 2 to 100, 10 to 100, 20 to 100, 10 to 200, 20 to 200, 50 to 200, 10 to 300, 20 to 300, or 50 to 300.

A thread layer, for example thread layer 200, can comprise any suitable number of thread lines. In some embodiments, a thread layer can comprise 10 or more thread lines. In some embodiments, a thread layer can comprise 20 or more thread lines. In some embodiments, a thread layer can comprise 50 or more thread lines. In some embodiments, a thread layer can comprise 100 or more thread lines. In some embodiments, a thread layer can comprise 200 or more thread lines. In some embodiments, a thread layer can comprise 300 or more thread lines. In some embodiments, a thread layer can comprise 500 or more thread lines. In some embodiments, a thread layer can comprise a number of thread lines in a range of 10 to 300. For example, a thread layer can comprise 10 to 300, 50 to 300, 100 to 300, or 150 to 300 thread lines. In some embodiments, a thread layer can comprise 10 to 500 thread lines. In some embodiments, a thread layer can comprise 100 to 500 thread lines. In some embodiments, a thread layer can comprise 100 to 1000 thread lines.

In some embodiments, thread lines 204 can be bonded at anchor points 290. In such embodiments, thread lines 204 can be bonded at anchor points 290 via an adhesive, a bonding layer, thermal (conductive or convective) heat (for example, in a heat press or oven), IR (infrared) heating, laser heating, microwave heating, steam, a mechanical fastener (for example, a clip), hook and loop fasters, needle-punching, hydro-entanglement, ultrasonic/vibratory entanglement, felting, knotting, chemical bonding with a catalyst of biomaterial, adhesive spraying (for example, CNC adhesive spray deposition), or by pushing one thread line through the other thread line(s).

In some embodiments, thread lines 204 can be directly bonded together at anchor points 290. In some embodiments, thread lines 204 can be directly bonded together at anchor points 290 via a polymeric material of continuous thread 202. For example, heat and/or pressure can be applied to directly bond thread lines 204 at anchor points 290. In embodiments where heat and/or pressure is utilized to directly bond the polymeric material of thread lines 204, the thread lines 204 can be thermally fused together at one or more anchor points 290. In embodiments comprising direct bonding of thread lines 204 at anchor points 290, thread lines 204 can be directly bonded at anchor points 290 without the use of an adhesive or bonding layer.

In some embodiments, thread lines 204 can be bonded together via a bonding layer. In some embodiments, thread lines 204 can be bonded together at anchor points 290 via a bonding layer. In such embodiments, the bonding layer can be, for example, a laminated layer, an adhesive layer, a stitched layer, a cured layer, a screen-printed layer, or a blown fiber layer. In some embodiments, the blown fiber layer can comprise polymeric fibers that can bond thread lines 204.

In some embodiments, thread lines 204 can be bonded together without the use of a bonding layer. For example, in some embodiments, thread lines 204 can be directly bonded together via, for example, but not limited to, direct local bonding via material(s) of thread lines 204, needle punching, hydro-entanglement, and ultrasonic/vibratory entanglement.

In some embodiments, thread lines 204 can be bonded at points where two or more thread lines 204 overlap in thread layer 200 (i.e., intersection points 206). Thread lines 204 can be bonded at intersection points 206 via an adhesive, a bonding layer, thermal (conductive or convective) heat (for example, in a heat press or oven), IR (infrared) heating, laser heating, microwave heating, steam, a mechanical fastener (for example, a clip), hook and loop fasters, needle-punching, hydro-entanglement, ultrasonic/vibratory entanglement, felting, knotting, chemical bonding with a catalyst of biomaterial, adhesive spraying (for example, CNC adhesive spray deposition), or by pushing one thread line through the other thread line(s). Intersection points 206 for thread lines can be referred to as "overlap points" or "points of overlap."

In some embodiments, thread lines 204 can be directly bonded together at intersection points 206. In some embodiments, thread lines 204 can be directly bonded together at intersection points 206 via the polymeric material of continuous thread 202. In embodiments comprising direct bonding of thread lines 204 at intersection points 206, thread lines 204 can be bonded at intersection points 206 without the use of an adhesive or bonding layer. For example, heat and/or pressure can be applied to thread layer 200 to directly bond thread lines 204 at intersection points 206. In embodiments where heat and/or pressure is utilized to directly bond the polymeric material of thread lines 204, the thread lines 204 can be thermally fused together at one or more intersection points 206.

In some embodiments, a bonding layer can bond thread lines 204 together at a plurality of intersection points 206 within thread layer 200. In such embodiments, the bonding layer can be, for example, a laminated layer, an adhesive layer, a stitched layer, a cured layer, a screen-printed layer, or a blown fiber layer comprising polymeric fibers that can bond thread lines 204.

In some embodiments, continuous thread 202 can comprise overlaying thread lines 204. As used herein, "overlaying thread lines" means two or more thread lines that follow the same path between two respective anchor points. Overlaying thread lines need not be overlaid directly over each other. Two or more thread lines are considered overlaying as long as they extend between the same two anchor points.

The thread lines 204 of thread layer 200 may not be woven or knitted together. In such embodiments, thread lines 204 can be referred to as "non-woven" and "non-knitted" thread lines. The thread lines 204 of thread layer 200 may not be embroidered threads stitched to a base layer. In such embodiments, thread lines 204 may be referred to as "non-embroidered" thread lines.

In some embodiments, continuous thread 202 can be a polymer thread. As used herein, "polymer thread" means a thread composed at least in part of a polymeric material. In some embodiments, a polymer thread can be composed entirely of one or more polymeric materials. In some embodiments, a polymer thread can comprise a polymeric material coated around a core (which may or may not be composed of a polymeric material).

Suitable polymeric materials for polymer threads discussed herein comprise, but are not limited to, thermoplastic polyurethane (TPU), a rubber, and silicone. In some embodiments, the TPU can be recycled TPU.

In some embodiments, the polymeric material for polymer threads can comprise a melting temperature in a range of greater than or equal to 110° C. to less than or equal to 150° C. In such embodiments, the polymeric material can be referred to as a "low melting temperature polymeric material."

In some embodiments, continuous thread 202 of thread layer 200 can have a denier in the range of from 1 denier to 3000 denier, including subranges. For example, continuous thread 202 can have a denier of 1, 10, 50, 100, 200, 300, 400, 500, 600, 700, 800, 900, 1000, 1100, 1200, 1300, 1400, 1500, 1600, 1700, 1800, 1900, 2000, 2500, or 3000 denier, or within any range having any two of these values as endpoints. For example, in some embodiments, continuous thread 202 can have a denier in the range of from 10 denier to 2500 denier, from 50 denier to 2000 denier, from 100 denier to 1900 denier, from 200 denier to 1800 denier, from 300 denier to 1700 denier, from 400 denier to 1600 denier, from 500 denier to 1500 denier, from 600 denier to 1400 denier, from 700 denier to 1300 denier, from 800 denier to 1200 denier, from 900 denier to 1100 denier, or from 900 denier to 1000 denier.

Thread patterns as described herein can comprise any number of thread layers. For example, a thread pattern can comprise two or more, three or more, four or more, five or more, six or more, seven or more, eight or more, nine or more, ten or more, fifteen or more, or twenty or more thread layers. For example, a thread pattern can comprise thread layer 200 and thread layer 220.

Continuous threads of any thread layer can be wound around and extended between anchor points 290 in the same fashion as described above for continuous thread 202. Further, thread lines of the continuous threads of any thread layer can be bonded in the same manner as described above for thread layer 200.

Like continuous thread 202, continuous thread for other thread layers can comprise a plurality of thread lines wound around and extending between two respective anchor points. In some embodiments, continuous threads of different thread layers can be the same thread material. In some embodiments, continuous threads of different thread layers can be composed of different thread materials. In such embodiments, the materials for different continuous threads in a thread pattern can be selected to provide targeted characteristics to areas of a thread pattern, and therefore an article of apparel. In some embodiments, the denier of continuous threads in different thread layers within a thread pattern can be selected to provide varying degrees of a characteristic (for example, strength or stretchability) to different areas of the thread pattern.

In embodiments comprising a thread pattern with a plurality of thread layers, the plurality of thread layers can be layered over each other. For example, thread layer 200 can define a first layer of a thread pattern and second thread layer 220 can define a second layer of the thread pattern. Different thread layers of a thread pattern can be disposed over each other in areas of overlap between the two thread layers. For example, a first thread layer 200 can be disposed over second thread layer 220, or vice versa, in areas of overlap between the two thread layers.

In embodiments comprising a thread pattern with a plurality of thread layers, the plurality of thread layers can be bonded to each other in the thread pattern. In some embodiments, one or more of the layers can be directly bonded to each other via the polymeric material of a continuous thread defining thread lines for at least one of the layers. In some embodiments, one or more of the layers can be bonded via a bonding layer. In such embodiments, the bonding layer can be, for example, a laminated layer, an adhesive layer, a stitched layer, a cured layer, a screen-printed layer, or a blown fiber layer.

In some embodiments, one or more thread layers of a thread pattern can serve to bond other thread layers of the thread pattern together. In such embodiments, these one or more thread layers can be wound using a polymeric thread, which when heated, bonds other layers of the thread pattern together at anchor points and/or intersection points between continuous threads. For example, in a thread pattern comprising three thread layers, one of the three thread layers (for example, the middle thread layer) can be a wound using a polymeric thread that serves to bond all three thread layers together. In some embodiments, one or more thread layers of a thread pattern can be defined by a wound continuous thread coated or impregnated with an adhesive. In some embodiments, the adhesive can be activated with the application of heat. In some embodiments, the adhesive can be a dissolvable adhesive that, when contacted with a solvent, such as water, fully or partially dissolves to bond thread layers together.

Figure 8:
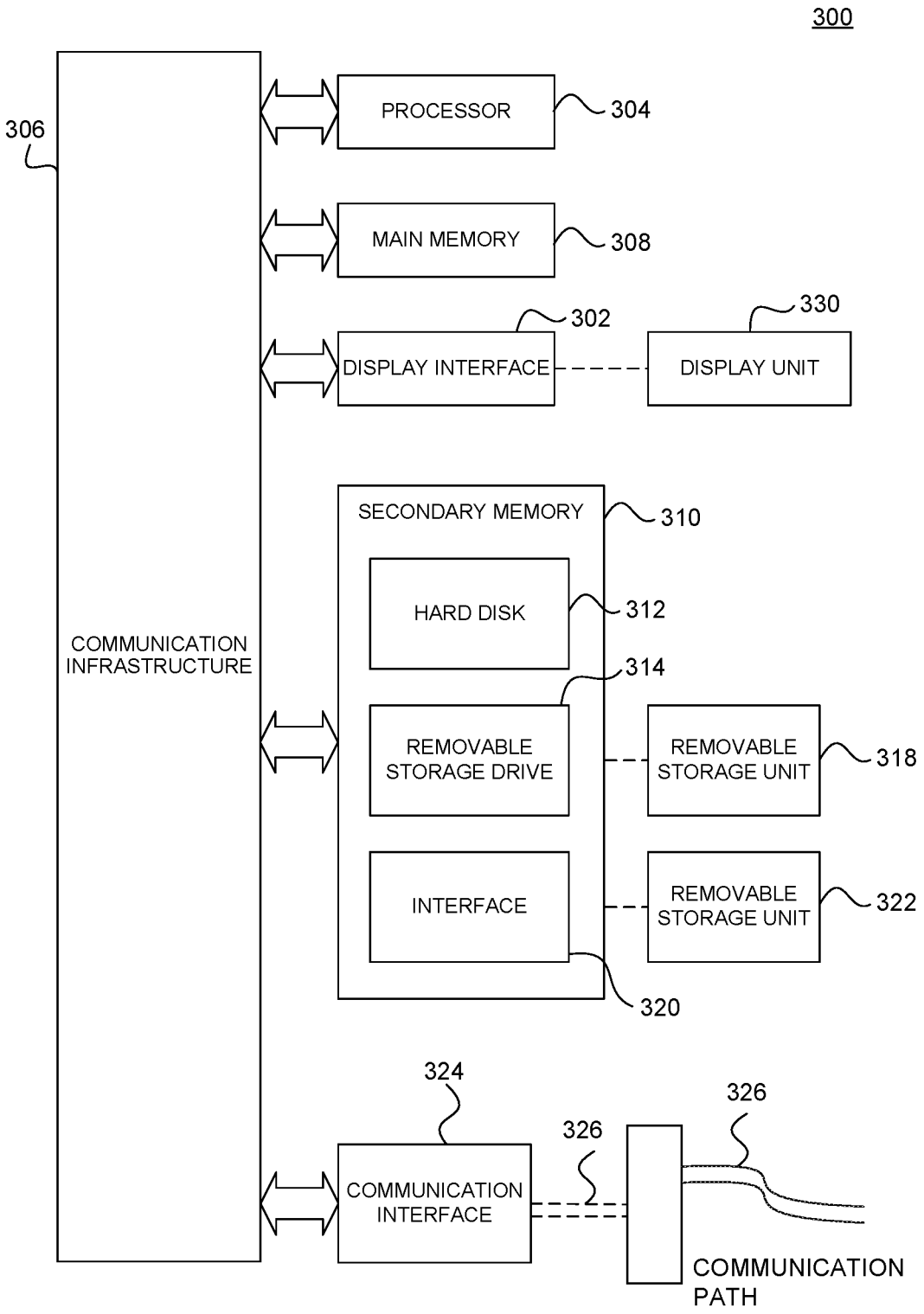
FIG. 8 shows a schematic block diagram of an exemplary computer system in which embodiments may be implemented.

FIG. 8 illustrates an exemplary computer system 300 in which embodiments, or portions thereof, may be implemented as computer-readable code. System 100 described can comprise computer system 300 such that computer system 300 acts as a controller for system 100. For example, aspects of the methods discussed herein may be implemented in computer system 300 using hardware, software, firmware, tangible computer readable media having instructions stored thereon, or a combination thereof and may be implemented in one or more computer systems or other processing systems.

If programmable logic is used, such logic may execute on a commercially available processing platform or a special purpose device. One of ordinary skill in the art may appreciate that embodiments of the disclosed subject matter can be practiced with various computer system configurations, including multi-core multiprocessor systems, minicomputers, and mainframe computers, computer linked or clustered with distributed functions, as well as pervasive or miniature computers that may be embedded into virtually any device.

For instance, at least one processor device and a memory may be used to implement the above-described embodiments. A processor device may be a single processor, a plurality of processors, or combinations thereof. Processor devices may have one or more processor "cores."

Various embodiments described herein may be implemented in terms of this example computer system 300. After reading this description, it will become apparent to a person skilled in the relevant art how to implement one or more of the embodiments using other computer systems and/or computer architectures. Although operations may be described as a sequential process, some of the operations may in fact be performed in parallel, concurrently, and/or in a distributed environment, and with program code stored locally or remotely for access by single or multi-processor machines. In addition, in some embodiments the order of operations may be rearranged without departing from the spirit of the disclosed subject matter.

Processor device 304 may be a special purpose or a general-purpose processor device. As will be appreciated by persons skilled in the relevant art, processor device 304 may also be a single processor in a multi-core/multiprocessor system, such system operating alone, or in a cluster of computing devices operating in a cluster or server farm. Processor device 304 is connected to a communication infrastructure 306, for example, a bus, message queue, network, or multi-core message-passing scheme.

Computer system 300 also comprises a main memory 308, for example, random access memory (RAM), and may also comprise a secondary memory 310. Secondary memory 310 may comprise, for example, a hard disk drive 312, or removable storage drive 314. Removable storage drive 314 may comprise a floppy disk drive, a magnetic tape drive, an optical disk drive, a flash memory, a Universal Serial Bus (USB) drive, or the like. The removable storage drive 314 reads from and/or writes to a removable storage unit 318 in a well-known manner. Removable storage unit 318 may comprise a floppy disk, magnetic tape, optical disk, etc. which is read by and written to by removable storage drive 314. As will be appreciated by persons skilled in the relevant art, removable storage unit 318 comprises a computer usable storage medium having stored therein computer software and/or data.

Computer system 300 (optionally) comprises a display interface 302 (which can comprise input and output devices such as keyboards, mice, etc.) that forwards graphics, text, and other data from communication infrastructure 306 (or from a frame buffer not shown) for display on display unit 330.

In additional and/or alternative implementations, secondary memory 310 may comprise other similar means for allowing computer programs or other instructions to be loaded into computer system 300. Such means may comprise, for example, a removable storage unit 322 and an interface 320. Examples of such means may comprise a program cartridge and cartridge interface (such as that found in video game devices), a removable memory chip (such as an EPROM, or PROM) and associated socket, and other removable storage units 322 and interfaces 320 which allow software and data to be transferred from the removable storage unit 322 to computer system 300.

Computer system 300 may also comprise a communication interface 324.

Communication interface 324 allows software and data to be transferred between computer system 300 and external devices. Communication interface 324 may comprise a modem, a network interface (such as an Ethernet card), a communication port, a PCMCIA slot and card, or the like. Software and data transferred via communication interface 324 may be in the form of signals, which may be electronic, electromagnetic, optical, or other signals capable of being received by communication interface 324. These signals may be provided to communication interface 324 via a communication path 326. Communication path 326 carries signals and may be implemented using wire or cable, fiber optics, a phone line, a cellular phone link, an RF link or other communication channels.

In this document, the terms "computer program medium" and "computer usable medium" are used to generally refer to media such as removable storage unit 318, removable storage unit 322, and a hard disk installed in hard disk drive 312. Computer program medium and computer usable medium may also refer to memories, such as main memory 308 and secondary memory 310, which may be memory semiconductors (for example, DRAMs, etc.).

Computer programs (also called computer control logic) are stored in main memory 308 and/or secondary memory 310. Computer programs may also be received via communication interface 324. Such computer programs, when executed, enable computer system 300 to implement the embodiments as discussed herein. In particular, the computer programs, when executed, enable processor device 304 to implement the processes of the embodiments discussed here. Accordingly, such computer programs represent controllers of the computer system 300. Where the embodiments are implemented using software, the software may be stored in a computer program product and loaded into computer system 300 using removable storage drive 314, interface 320, and hard disk drive 312, or communication interface 324.

Figure 9B:
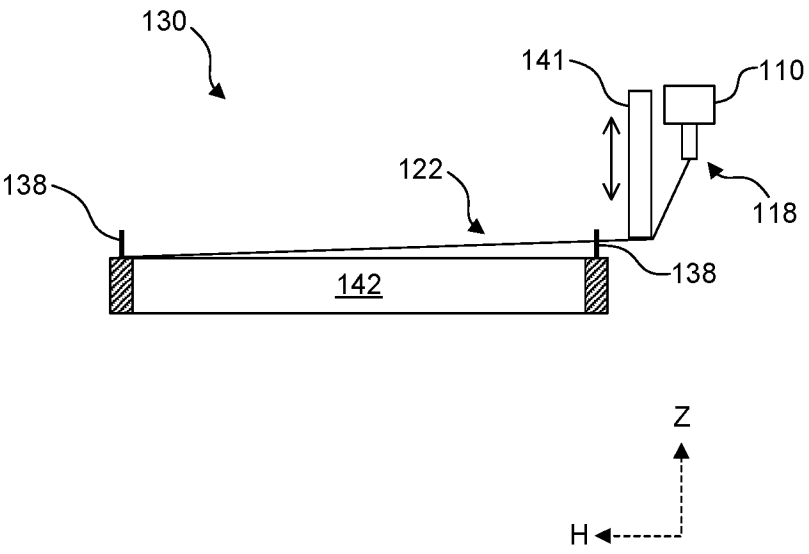
FIGS. 9A and 9B illustrate steps in a winding method according to some embodiments.
Figure 9A:
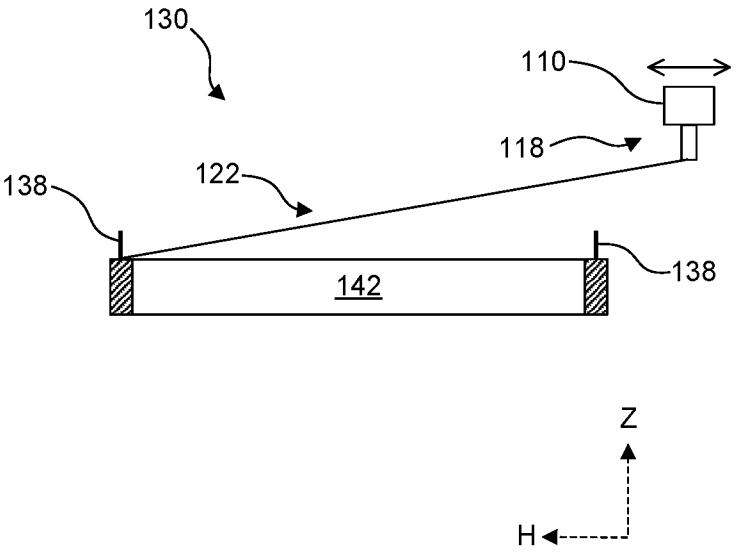

In some embodiments, as shown in FIGS. 9A and 9B, a process of winding continuous thread 122 about projections 138 can comprise one or more steps that comprise moving winding head 110 horizontally while dispensing ends of thread guides 118 are above projections 138 in the Z direction. In embodiments comprising one or more of these steps, the dispensing ends of the thread guides 118 do not pass between adjacent projections 138 during the step. In FIGS. 9A and 9B, "H" indicates a horizontal axis, which may be the X axis or the Y axis in FIGS. 1A and 1B. In some embodiments, a process of winding continuous thread 122 about projections 138 can comprise one or more steps that comprise passing dispensing ends of the thread guides 118 between adjacent projections 138 in a passing step as described herein and one or more steps that comprise moving winding head 110 such that the dispensing ends of thread guides 118 are above projections 138 and do not pass between adjacent projections 138.

Moving winding head 110 across projections 138 while dispensing ends of thread guides 118 are positioned above projections 138 can enable winding thread 122 onto projections without requiring the spatial and dimensional relationships between thread guides 118 and projections 138 described above with regard to FIG. 2. Moving winding head 110 across projections 138 while thread guides 118 are positioned above projections 138 can also facilitate winding threads 122 onto non-linear or curved arrangements of projections 138.

In embodiments in which dispensing ends of thread guides 118 are not passed through adjacent projections 138 during a winding step, winding head 110 can be moved downwards in the Z direction outside of winding field 142 to position threads 122 between adjacent projections 138. After moving downwards, the winding head 110 can be moved upward in the Z direction to again position the dispensing ends of thread guides 118 above projections 138. Further, in embodiments in which dispensing ends of thread guides 118 are not passed through adjacent projections 138, system 100 can comprise a depressor 141 to vertically hold portions of threads 122 between projections 138 and allow winding head 110 to moved upward in the Z direction without unwinding the threads 122 from projections 138. Depressor 141 may further be used to hold threads 122 in place while winding head 110 is repositioned horizontally relative to support plate 130 before a subsequent winding step.

Figure 10B:
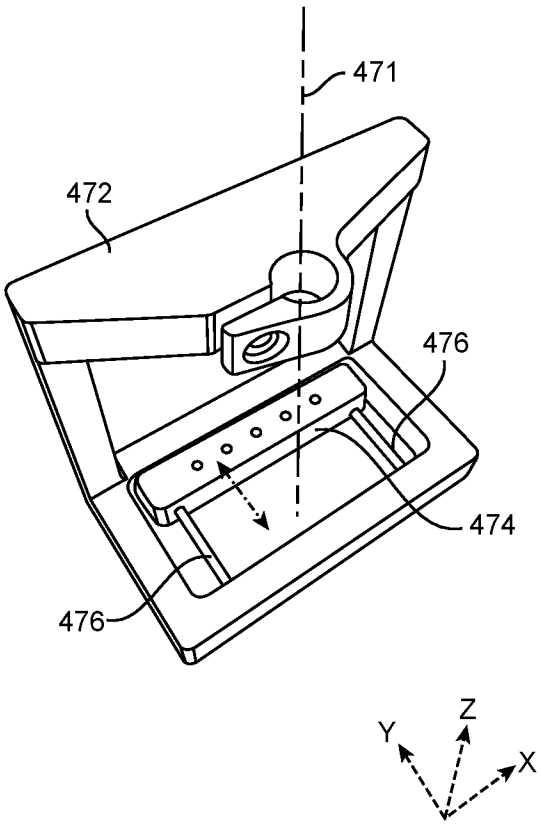
FIG. 10B illustrates a trailing arm of the winding head of FIG. 10A.
Figure 10A:
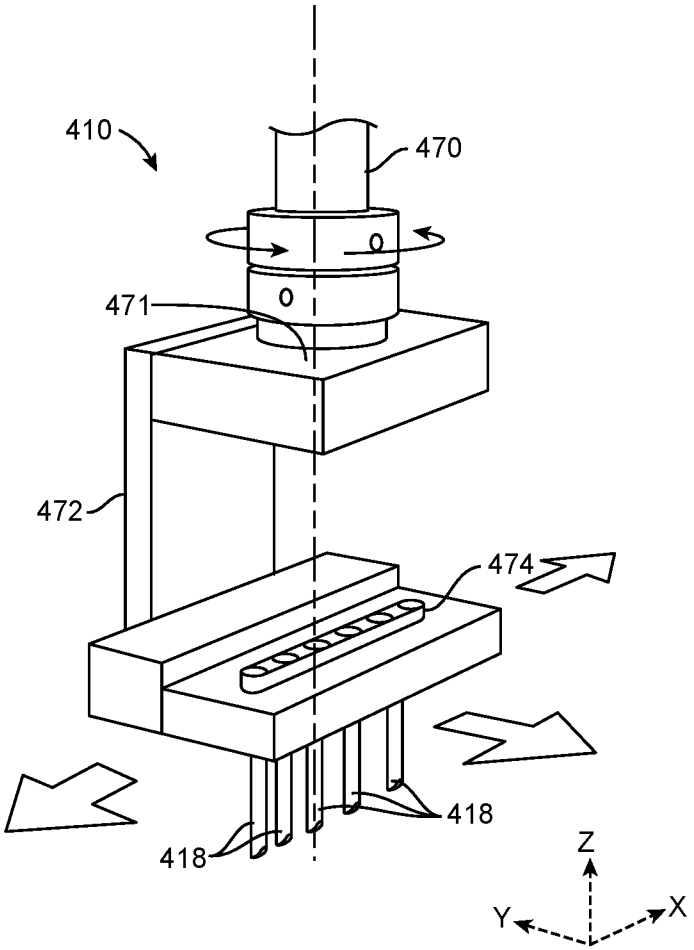
FIG. 10A illustrates a winding head according to some embodiments.

FIG. 10A illustrates a winding head 410 according to some embodiments. Winding head 410 is compatible with system 100. Accordingly, winding head 410 is usable in place of winding head 110 in any of the processes described above. Moreover, winding head 410 may be alike to winding head 110 in all respects other than differences specifically illustrated or described herein.

Winding head 410 comprises a leading arm 470. Leading arm 470 can be moved by actuators of system 100 to move winding head 410 relative to support plate 130. Winding head 410 further comprises a trailing arm 472. Trailing arm 472 is rotatable relative to leading arm 470 about a rotation axis 471 that is parallel to the Z axis. Thread guides 418 are coupled to trailing arm 472. Accordingly, a position of thread guides 418 relative to leading arm 470 varies as trailing arm 472 rotates relative to leading arm 470. In some embodiments, rotation of trailing arm 472 relative to leading arm 470 can be controlled by one or more mechanical actuators. In some embodiments, trailing arm 472 can be configured to rotate freely relative to leading arm 470. In such embodiments, trailing arm 472 may not be controlled by an actuator.

In embodiments wherein trailing arm 472 is configured to rotate freely relative to leading arm 470, trailing arm 472 may rotate relative to leading arm 470 in response to a direction of tension on threads 122 as winding head 410 is used to wind threads 122 about projections 138. In some embodiments, thread guides 418 can be arranged asymmetrically about trailing arm's 472 axis of rotation 471 relative to leading arm 470. In some embodiments, thread guides 418 can be additionally or alternatively arranged in a row that does not intersect trailing arm's 472 axis of rotation 471 relative to leading arm 470. In such embodiments, the thread guides 418 can be arranged in a row that is offset from the axis of rotation 471. In embodiments wherein thread guides 418 are arranged asymmetrically about trailing arm's 472 axis of rotation 471 relative to leading arm 470, a center point of the arrangement of thread guides 418 can trail behind leading arm 470 in response to tension on threads 122. Trailing arm 472 may thus act like a "drag knife."

In some embodiments, including the illustrated embodiment, thread guides 418 can be arranged in a row that is perpendicular to the direction of the offset between axis of rotation 471 and the center point of the arrangement of thread guides 418. In such embodiments, the row of thread guides 418 can remain parallel to the direction of tension on threads 122 as a whole. In some such embodiments, the row of thread guides 418 can tend to remain perpendicular to a net direction of travel of winding head 410 from the last projection(s) 138 about which threads 122 were wound.

In some embodiments, thread guides 118 can be coupled to a movable block 474, as shown, for example, in FIG. 10B. Movable block 474 can be configured to translate relative to other portions of trailing arm 472. Movable block 474 can therefore enable changes in the magnitude and direction of the offset between the center point of the arrangement of thread guides 418 and the axis of rotation of trailing arm 472 in response to changes in the direction of tension on threads 122 relative to leading arm 470 and trailing arm 472. Movable block 474 can be movable relative to trailing arm 472 by any mechanism, such as, for example, by sliding along rails 476 comprised by trailing arm 472.

Figure 11C:
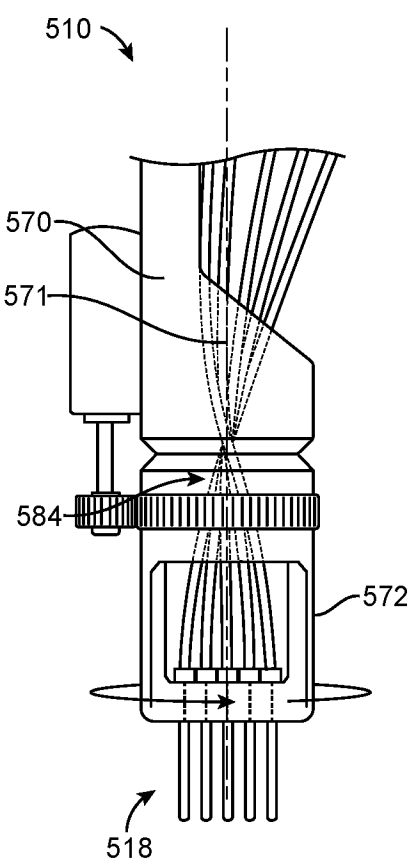
FIGS. 11A-11C illustrate a winding head according to some embodiments.
Figure 11B:
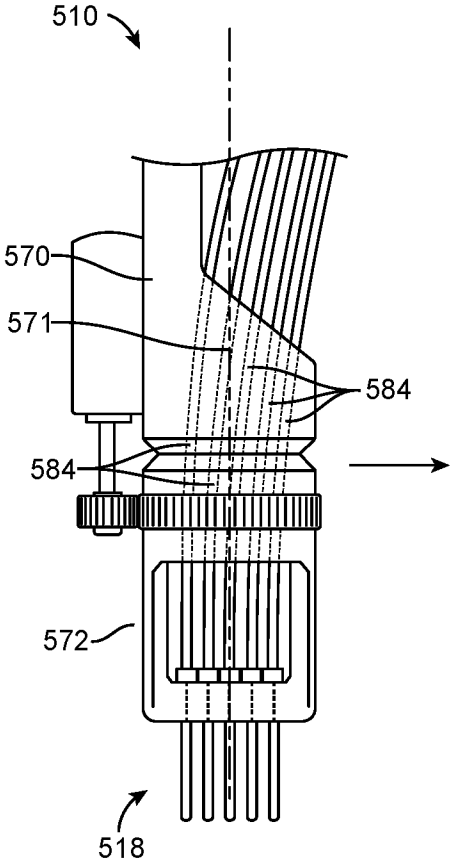
Figure 11A:
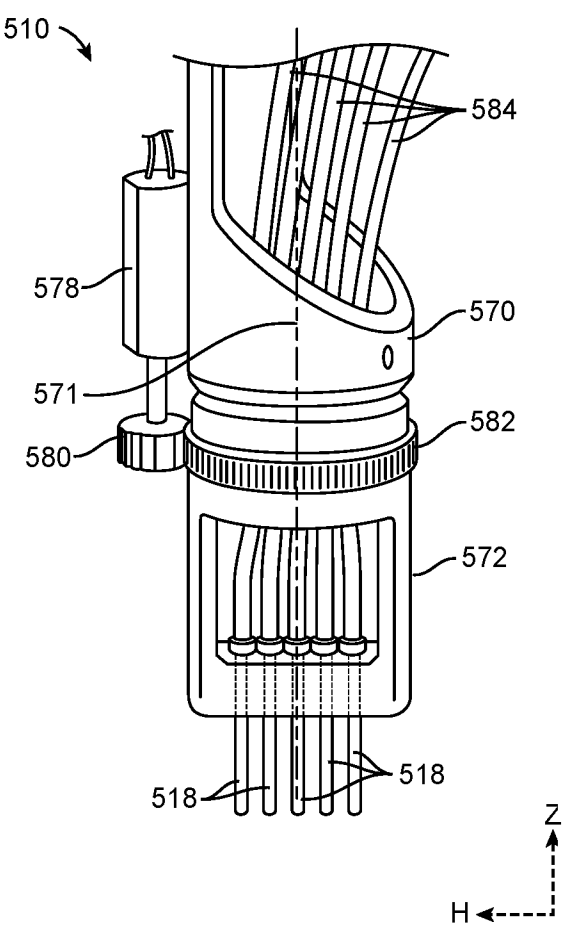

FIGS. 11A-11C illustrate a winding head 510 according to some embodiments. Winding head 510 is compatible with system 100. Accordingly, winding head 510 is usable in place of winding head 110 in any of the processes described above. Moreover, winding head 510 may be alike to winding head 110 in all respects other than differences specifically illustrated or described herein.

Winding head 510 comprises a leading arm 570. Leading arm 570 can be moved by actuators of system 100 to move winding head 510 relative to support plate 130. Winding head 510 further comprises a trailing arm 572. Trailing arm 572 is rotatable relative to leading arm 570 about a rotation axis 571 that is parallel to the Z axis. Thread guides 518 are coupled to trailing arm 572. Accordingly, a position of thread guides 518 relative to leading arm 570 varies as trailing arm 572 rotates relative to leading arm 570.

In some embodiments, winding head 510 can comprise a drive gear 580 and a ring gear 582 to rotate leading arm 570 relative to trailing arm 572. Drive gear 580 can be motorized. Movement of drive gear 580 can cause ring gear 582 to rotate. Ring gear 582 can be configured to cause trailing arm 572 to rotate relative to leading arm 570 about the axis of rotation 571 when ring gear 582 is rotated. Accordingly, rotation of trailing arm 582 relative to leading arm 580 can be motorized. For example, in some embodiments, winding head 510 can comprise a motor 578 configured to actuate drive gear 580 to rotate ring gear 582. In some embodiments, trailing arm 572 can comprise the ring gear 582. In some embodiments, leading arm 570 572 can comprise the ring gear 582. In some embodiments, motor 578 can be fixed to the arm 570, 572 that does not comprise ring gear 582.

Winding head 510 can comprise conduits 584 configured to guide thread 122 to thread guides 518. Any other winding heads disclosed herein can comprise similar conduits configured to guide thread 122 to their respective thread guides. Within winding head 510, conduits 584 can facilitate smooth dispensing of thread 122 through thread guides 518 at various rotational positions of trailing arm 572 relative to leading arm 570 by allowing threads 122 to continue to slide freely within conduits 584 even when trailing arm 572 is rotated to a position that causes conduits 584 and threads 122 to become twisted as shown in FIG. 11C.

Embodiments described herein also may be directed to computer program products comprising software stored on any computer useable medium. Such software, when executed in one or more data processing device, causes a data processing device(s) to operate as described herein. Embodiments described herein may employ any computer useable or readable medium. Examples of computer useable mediums include, but are not limited to, primary storage devices (for example, any type of random access memory), secondary storage devices (for example, hard drives, floppy disks, CD ROMS, ZIP disks, tapes, magnetic storage devices, and optical storage devices, MEMS, nanotechnological storage device, etc.).

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventor(s), and thus, are not intended to limit the present invention(s) and the appended claims in any way.

The present invention(s) have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention(s) should not be limited by any of the above-described exemplary embodiments, but should be defined only in accordance with the following claims and their equivalents.

What is claimed is:

1. A system for manufacturing an article of apparel, the system comprising:

a plate comprising a plurality of projections;

a winding head comprising a plurality of adjacent thread guides, wherein the thread guides among the plurality of thread guides are configured to simultaneously dispense respective continuous threads; and an actuator configured to move the winding head over the plate to wind the continuous threads around the plurality of projections on the plate, wherein the actuator is configured to cause the winding head to translate relative to a lateral plane, and wherein the winding head is configured to rotate up to 180 degrees or more on a rotation axis perpendicular to the lateral plane.

2. The system of claim 1, wherein the plurality of adjacent thread guides is arranged linearly on the winding head.

3. The system of claim 1, wherein center points of the thread guides among the plurality of thread guides are spaced apart from each other on the winding head in a first direction by a first distance, and center points of the projections among the plurality of projections are spaced apart from each other on the plate by the first distance.

4. The system of claim 3, wherein the plurality of thread guides is coupled to a bottom surface of the winding head within an area that spans a second distance in a second direction that is less than the first distance such that the plurality of thread guides can pass between two adjacent projections of the plurality of projections sequentially as the winding head moves in a straight line.

5. The system of claim 1, wherein the system comprises a second actuator configured to rotate the winding head on the rotation axis.

6. The system of claim 1, comprising a plurality of spools, wherein each of the respective continuous threads extends from a respective spool among the plurality of spools such that dispensing the respective continuous threads unwinds the plurality of spools.

7. The system of claim 6, wherein each spool among the plurality of spools is biased toward winding a corresponding one of the respective threads about the spool.

8. The system of claim 6, wherein a first one of the plurality of spools comprises a first thread type and a second one of the plurality of spools comprises a second thread type different from the first thread type.

9. The system of claim 1, wherein the winding head comprises at least four thread guides.

10. The system of claim 1, comprising a depressor configured to hold portions of the continuous threads between projections among the plurality of projections while the winding head moves vertically.

11. The system of claim 1, wherein the winding head is configured to rotate by at least 180 degrees on the rotation axis.

12. A method of manufacturing an article of apparel, the method comprising:

threading a plurality of continuous threads onto a plurality of projections in a projection set disposed around a winding field by passing a plurality of thread guides on a winding head between the plurality of projections, wherein threading the plurality of continuous threads comprises a first passing step wherein respective continuous threads are each passed through a respective gap defined between a respective pair of adjacent projections among the projection set; and a second passing step wherein every continuous thread among the plurality of continuous threads is passed through a single gap defined between a single pair of adjacent projections among the projection set, and wherein the second passing step either follows or precedes the first passing step, wherein the thread guides simultaneously dispense respective continuous threads such that continuous threads are wound around the plurality of projections to form a thread layer comprising a plurality of thread lines, with each thread line extending between two respective projections of the plurality of projections and across the winding field.

13. The method of claim 12, wherein winding the continuous threads comprises moving the winding head relative to the projection set and across the winding field.

14. The method of claim 13, wherein the plurality of projections extends from a support plate.

15. The method of claim 12, wherein the respective continuous threads are each passed through the respective gap simultaneously.

16. The method of claim 12, wherein the first passing step comprises passing each thread guide among the plurality of thread guides through a respective one of the respective gaps.

17. The method of claim 12, wherein the winding head is rotated between the first passing step and the second passing step.

18. The method of claim 12, wherein the second passing step comprises passing every thread through the single gap sequentially.

19. The method of claim 12, comprising bonding the continuous threads in the thread layer after the first passing step and the second passing step.

* * * * *